US009512592B2

(12) United States Patent
Ranew, Jr.

(10) Patent No.: US 9,512,592 B2
(45) Date of Patent: Dec. 6, 2016

(54) SILT FENCE INSTALLATION EQUIPMENT AND METHOD

(71) Applicant: RANEW'S OUTDOOR EQUIPMENT, INC., Milner, GA (US)

(72) Inventor: Lester O. Ranew, Jr., Jackson, GA (US)

( * ) Notice: Subject to any disclaimer, the term of this patent is extended or adjusted under 35 U.S.C. 154(b) by 97 days.

(21) Appl. No.: 14/689,802

(22) Filed: Apr. 17, 2015

(65) Prior Publication Data

US 2016/0305085 A1 Oct. 20, 2016

(51) Int. Cl.

| | |
|---|---|
| ***E02F 5/10*** | (2006.01) |
| ***E02F 5/12*** | (2006.01) |
| ***E02F 5/14*** | (2006.01) |
| ***E02D 17/20*** | (2006.01) |
| ***E02F 5/08*** | (2006.01) |
| ***E02D 17/13*** | (2006.01) |
| ***E02D 7/20*** | (2006.01) |
| ***E02B 3/04*** | (2006.01) |

(52) U.S. Cl.

CPC ..... *E02D 17/202* (2013.01); *E02B 3/04* (2013.01); *E02D 7/20* (2013.01); *E02D 17/13* (2013.01); *E02F 5/08* (2013.01); *E02F 5/10* (2013.01); *E02F 5/145* (2013.01)

(58) Field of Classification Search

CPC ..... E02D 31/02; E02D 31/025; E02D 17/20; E02D 17/202; E02F 5/02; E02F 5/027; E02F 5/08; E02F 5/10; E02F 5/101; E02F 5/102; E02F 5/12; E02F 5/14; E02F 5/145

USPC .... 405/116, 174, 175, 179, 180, 181, 302.6, 405/302.7; 37/142.5, 462–464

See application file for complete search history.

(56) References Cited

U.S. PATENT DOCUMENTS

| | | | | |
|---|---|---|---|---|
| 3,044,194 | A * | 7/1962 | Balkheimer | E02F 5/06 172/460 |
| 3,182,459 | A | 5/1965 | Grether et al. | |
| 3,670,431 | A * | 6/1972 | Ede | A01B 15/025 172/699 |
| 3,787,989 | A * | 1/1974 | Heckathorn | E02F 3/08 37/349 |
| 4,050,171 | A * | 9/1977 | Teach | E02F 5/145 37/308 |
| 4,092,936 | A | 6/1978 | Griffin et al. | |
| 4,260,290 | A | 4/1981 | Flippin | |
| 5,121,800 | A | 6/1992 | Gabriel | |
| 5,671,554 | A * | 9/1997 | Geelhoed | E02F 5/145 172/4.5 |
| 5,906,167 | A | 5/1999 | Miyachi | |

(Continued)

*Primary Examiner* — John Kreck
*Assistant Examiner* — Stacy Warren

(57) ABSTRACT

An equipment for installing silt fencing includes a motive vehicle with an attached trencher to cut a trench having a predetermined depth and width. The trencher includes a cutting wheel and a trenching foot having a predetermined width for determining a width of a trench cut with the trenching assembly. The trencher is vertically positionable and a gauge is provided to the operator for controlling the depth of the trench as terrain and soil condition varies. The cutting wheel and trenching foot are also rotatable to control the orientation of the trench with respect to plumb. The equipment may also include a silt fence installation station including a power hammer on a positionable boom for another operator to use to drive the silt fence stakes into the ground. The equipment may also include a back filler on a side opposite the trencher for backfilling the trench.

25 Claims, 25 Drawing Sheets

(56) References Cited

U.S. PATENT DOCUMENTS

| | | | | |
|---|---|---|---|---|
| 5,915,878 | A | 6/1999 | Carpenter | |
| 6,053,665 | A | 4/2000 | Richardson | |
| 6,158,923 | A | 12/2000 | Wheeler et al. | |
| 6,551,031 | B2 * | 4/2003 | Van Ornum | E02D 17/12 405/15 |
| 6,796,747 | B1 | 9/2004 | Vreeland | |
| 6,945,739 | B1 * | 9/2005 | Putman | E02D 19/18 405/15 |
| 7,144,202 | B2 * | 12/2006 | McCormick | E02F 5/101 172/720 |
| 2002/0192029 | A1 | 12/2002 | Vreeland | |
| 2003/0132605 | A1 | 7/2003 | Wiers | |
| 2009/0110493 | A1 | 4/2009 | Rorabaugh et al. | |

* cited by examiner

SILT FENCE INSTALLATION EQUIPMENT AND METHOD

BACKGROUND OF THE INVENTION

1. Field of the Invention

The present invention relates generally to equipment for installing silt fencing, and more particularly, to a machine that includes trenching and post installation facilities.

2. Description of the Related Art

Silt fencing is used to control runoff and erosion at construction sites and other locations where runoff and erosion are noticed and must be controlled. Silt fencing is the typical temporary means of control that is applied to combat erosion and runoff. Silt fence installation has typically been a multi-step process requiring a trenching machine to cut a narrow trench in the ground, insertion of the bottom of the silt fence fabric into the trench, and subsequent installation of fence posts or stakes, to which the fence is finally attached, typically by stapling. The silt trench is generally backfilled and compacted to maintain the bottom of the silt fence in position.

Existing systems such as those disclosed in U.S. Patent Application Publication US20090110493A1 by Rorabaugh, et al., provide for formation of a slit trench with concurrent insertion of the silt fence fabric. However, subsequent manual installation of fence stakes is still needed and the fence must still be stapled to the stakes. Another system described in U.S. Patent Application Publication US20020192029 by Vreeland, includes a hydraulic stake driving device that is operated by the driver of the trench cutting tractor after the silt fence has been inserted in the ground. However, the silt fence still must be attached to the stakes subsequent to the stake installation.

Prefabricated silt fencing is available with stakes pre-attached at the factory, which eliminates the time-consuming stapling operation and provides for more uniform results, as variation in the quality of the staple attachment may be cause for inspectors to require corrective action. Further, some silt fence installations require a wide anchorage trench that secures the bottom of the silt fence at a specified depth by extending the bottom of the silt fence along the bottom of the trench. The posts are installed in the trench, as well. Backfilled soil retains the bottom of the silt fence at its installed position by virtue of the weight of the soil and compaction. Existing systems that are designed for installation of prefabricated silt fencing, such as the system disclosed in U.S. Pat. No. 6,158,923, form a trench by pushing a plow having a rectangular profile through the earth and then automatically installing the fence stakes. The result is that variations in inclination of the surrounding earth, and thus the motive vehicle, will be reflected in the inclination of the installed stakes and the inclination of the bottom and sides of the trench, which also reduces the trench depth along one side. Plows are also sensitive to soil and rock conditions, and may ride out of the trench or fail if the resistance of the ground is too high, such as when a large root or rock is encountered.

Therefore, it would be desirable to provide silt fence installation equipment and methods that are compatible with wide anchorage trench installations in a variety of soil conditions and that can install prefabricated silt fencing vertically and form a trench having vertical sides and a flat bottom. It is further desirable to streamline the process of trenching, post installation and backfilling so that efficiency of the silt fence installation process is improved.

SUMMARY OF THE INVENTION

The objective of providing silt fence installation equipment and methods that can form a vertical trench in varied soil conditions, install prefabricated silt fencing vertically, and improve the overall efficiency of the silt fence installation process is accomplished in fence installation equipment and methods of use.

The fence installation equipment includes a motive vehicle and a trencher having a cutting wheel for forming a trench and trenching foot for referencing the sides of and smoothing a bottom of the trench. The trenching foot has predetermined width for determining a final width of the trench. The cutting wheel, which may be a bladed cutting wheel, is sized to cut a swath having substantially the predetermined width. The predetermined width is greater than a width of the pre-attached stakes so that the silt fencing and pre-attached stakes can be inserted into a bottom of the trench without further disturbing soil at the top of the trench. A free-floating foot is coupled to a depth gauge visible to an operator of the motive vehicle and rides in the trench behind the trenching foot so that the depth of the cutting wheel and trenching foot can be accurately controlled by the operator by operating a first powered arm attached to the motive vehicle that raises and lowers the trencher to maintain the desired trench depth. A frame of the trencher that supports the cutting wheel and trenching foot is also rotated in an axis parallel to a direction of travel by operating an actuator. A gauge is provided to indicate the vertical alignment of the trencher so the operator can operate the actuator to position the trencher frame so that the cutting wheel and trenching foot are aligned to cut the trench plumb to the earth while the slope of the terrain varies.

A station for a second operator may be provided on the equipment and behind the trencher. The station includes a cradle for handling the silt fence and a swingable boom having a powered impact driver for driving the stakes into the trench bottom. The swingable boom can be locked at a continuously selectable position by the second operator operating a locking mechanism at the end of the boom. The cradle may be fed by a pallet mounted on the back of the motive vehicle and the pallet may be adapted for loading from a fork lift.

The equipment may include a back filler that includes a fence guide and optionally a blower to position the bottom of the silt fence in the trench, a blade to move the piled soil adjacent to the trench into the trench, and one or more tampers, disk packers and/or finishing wheels. In an alternative embodiment, the back filler may use a slatted drum-type power back filler in place of the blade to move the piled soil adjacent to the trench into the trench.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein like reference numerals indicate like components, and:

DESCRIPTION OF ILLUSTRATIVE EMBODIMENT

The present invention includes fence installation equipment for installing silt fence and/or other fencing requiring a trenched installation. In particular, a heavy motive vehicle is adapted for soil trench cutting and concurrent installation of a silt fence with an optional back filler to close and compact the trench. The motive vehicle operates from only one side of a swath of the trench, i.e., the path of the trench including the portion that is not yet cut, without contacting the ground on the other side of the swath. Thus, the equipment described herein can be operated solely on a disturbance zone side of the silt fencing, so that access to property alongside a construction site is not required.

Figure 1A:
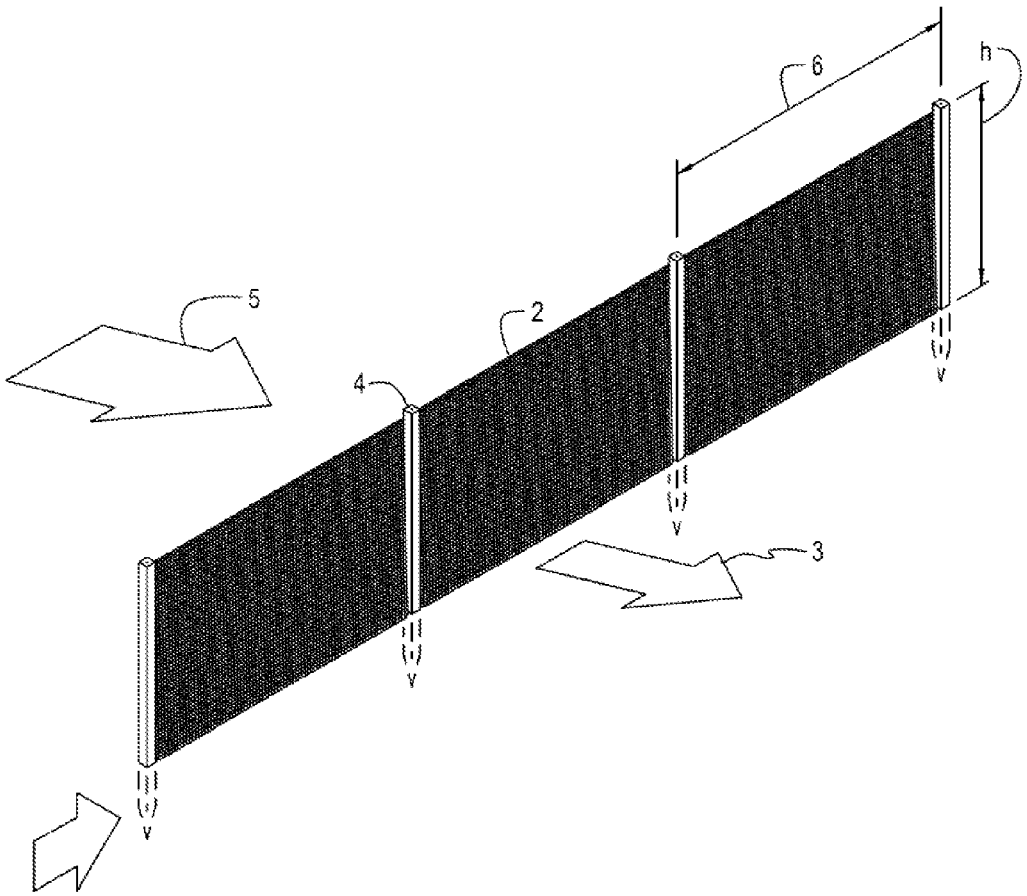
FIG. 1A is a perspective view of a silt fence installation as may be performed by the equipment and methods described herein.

Referring now to Figures, and in particular to FIG. 1A, a silt fence installation is shown as may be performed by the equipment described herein. A silt fence fabric 2, and optionally a backing wire screen or webbing, is supported by stakes 4 that are driven at periodic intervals into topsoil of a (soil) protection zone 3 in which surface water flows, but in which soil movement is prevented by silt fence fabric 2. Silt fence fabric 2 is generally stapled to stakes 4, and installed at intervals 6. Stakes 4 support silt fence fabric 2, which extends above ground to a height h. Uphill of and/or beyond silt fence fabric 2, surface water and silt flow in a (soil) disturbance zone 5, which is generally due to construction in the disturbance zone 5 that provides a path for surface water and silt to flow that was not previously subject to erosion. The intervals between stakes 4 and the height of silt fence fabric 2 are generally specified by site-relevant engineering codes. The codes also generally specify the amount of, and sometimes the shape of, the buried portion of silt fence fabric 2, which extends below the top of the ground into the soil, so that silt does not flow under silt fence fabric 2.

Figure 1B:
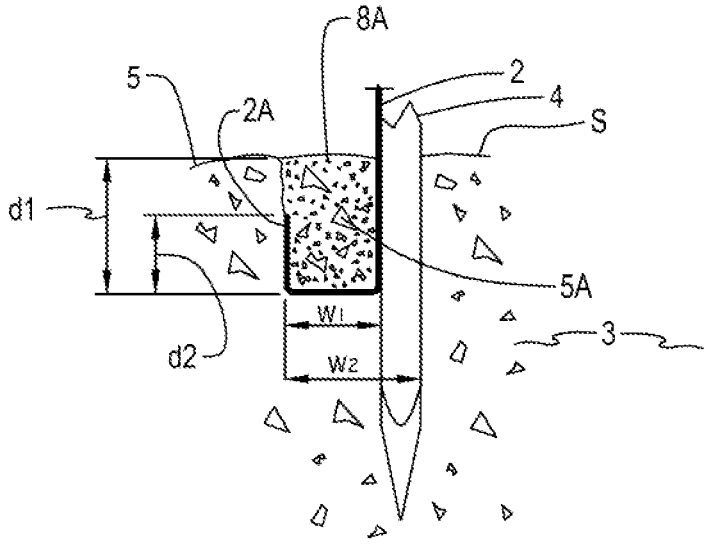
FIGS. 1B-1C are cross-section views of two different silt fence installations as may alternatively be included in the silt fence installation depicted in FIG. 1A.

Referring now to FIG. 1B, a cross section view shows a first type of silt fence installation that can be performed using the equipment described herein. Stakes 4 extend into topsoil adjacent to the protection zone 3, and a bottom portion 2A of silt fence fabric 2 extends along stakes 4 underground in the disturbance zone 5. Silt fence fabric bottom portion 2A extends into the topsoil to a specified depth $d_1$ below a surface S, and along the bottom of a trench 8A, extends a specified distance $w_1$ back into disturbance zone 5 and then upward again a second distance d2, forming a J-shaped profile that is secured by backfill soil 5A. In order to perform the illustrated installation while driving stakes 4 into the bottom of trench 8A, trench 8A must have a width of $w_2 \geq w_1$+stake width.

Figure 1C:
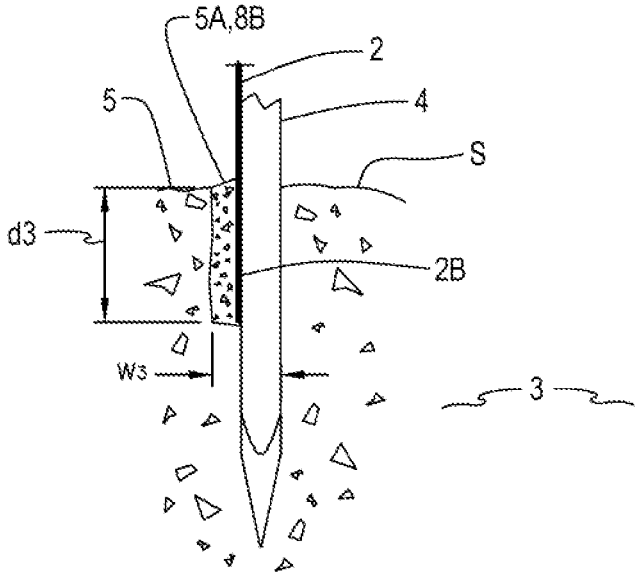

Referring now to FIG. 1C, a cross section view shows a second type of silt fence installation that can be performed using the equipment described herein. Stakes 4 extend into topsoil at the edge of protection zone 3 and a bottom portion 2B of silt fence fabric 2 extends along stakes 4 underground in disturbance zone 5. Silt fence fabric bottom portion 2B extends into the topsoil to a specified depth $d_3$ below surface S, but does not extend along the bottom of a trench 8B, as the requirements in the depicted installation do not require a J-shaped profile to secure silt fence fabric 2. In order to perform the illustrated installation, trench 8B must have a width of $w_3 \geq$stake width. Other types of silt fence fabric installations, as well as other types of fencing may be installed using equipment and techniques as described herein, and the particular configurations illustrated in FIGS. 1A-1C are intended to be examples of installations, but do not limit the potential types and configurations of material that may be installed using the described equipment.

Figure 2A:
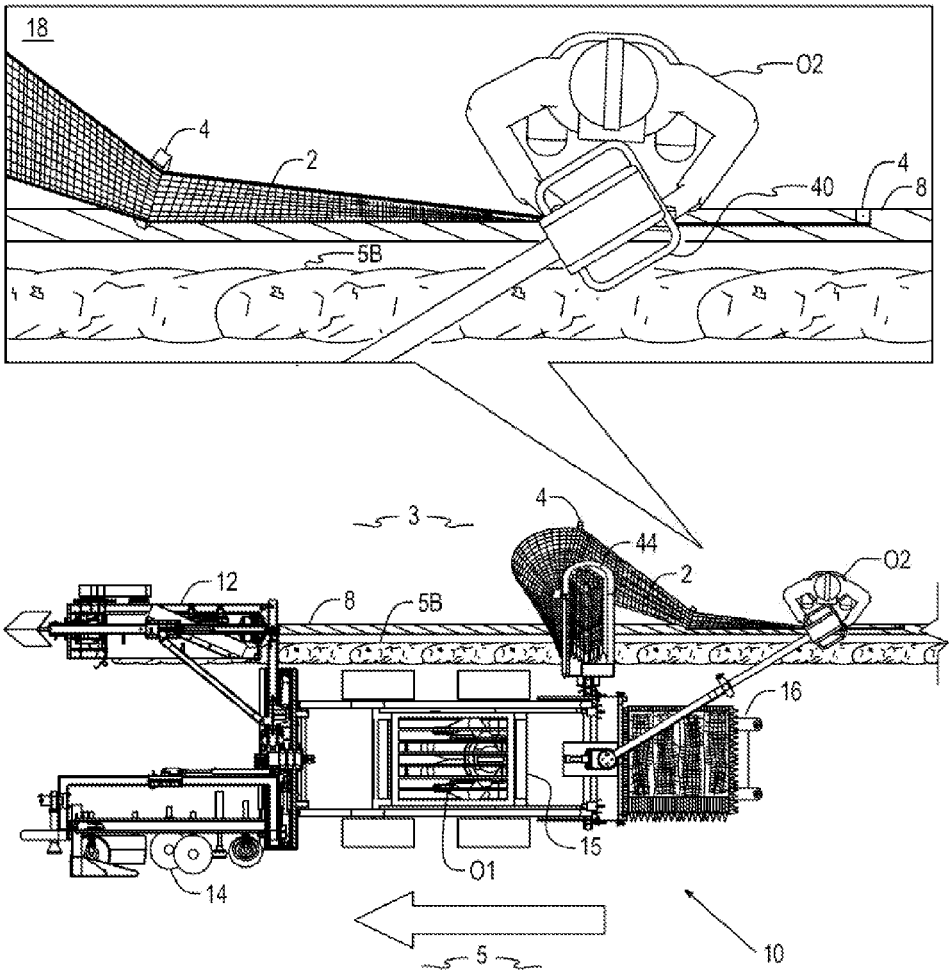
FIG. 2A is a top view of an example of a silt fence installation equipment performing installation of a silt fence.

Referring now to FIG. 2A, a top view of an example of a silt fence installation equipment 10 is shown, which includes a motive vehicle 15 operated by a first operator O1, to which a trencher 12, a back filler 14 and a second operator station 16 in use by a second operator O2, are fitted. Motive vehicle 15 may be, for example, a skid steer, an excavator, agricultural tractor, remote controlled utility tractor, or other equipment suitable for mounting and moving trencher 12, back filler 14 and second operator station 16. In the depicted configuration, motive vehicle 15 is moving in the direction of the depicted arrow in disturbance zone 5. Trencher 12 is engaged, cutting a trench 8 and leaving soil 5B alongside trench 8, back filler 14 is stowed, and silt fence fabric 2 and stakes 4 are being deployed from a cradle 44. Cradle 44 holds a quantity of prefabricated silt fence that has been loaded from another portion of second operator station 16. A detail 18 shows second operator O2 using a power hammer (not shown) attached to an end of a telescoping boom 40 of second operator station 16 to drive one of stakes 4 into soil at the bottom of trench 8. Trencher 12, back filler 14 and second operator station 16 will be described in further detail below.

Figure 2B:
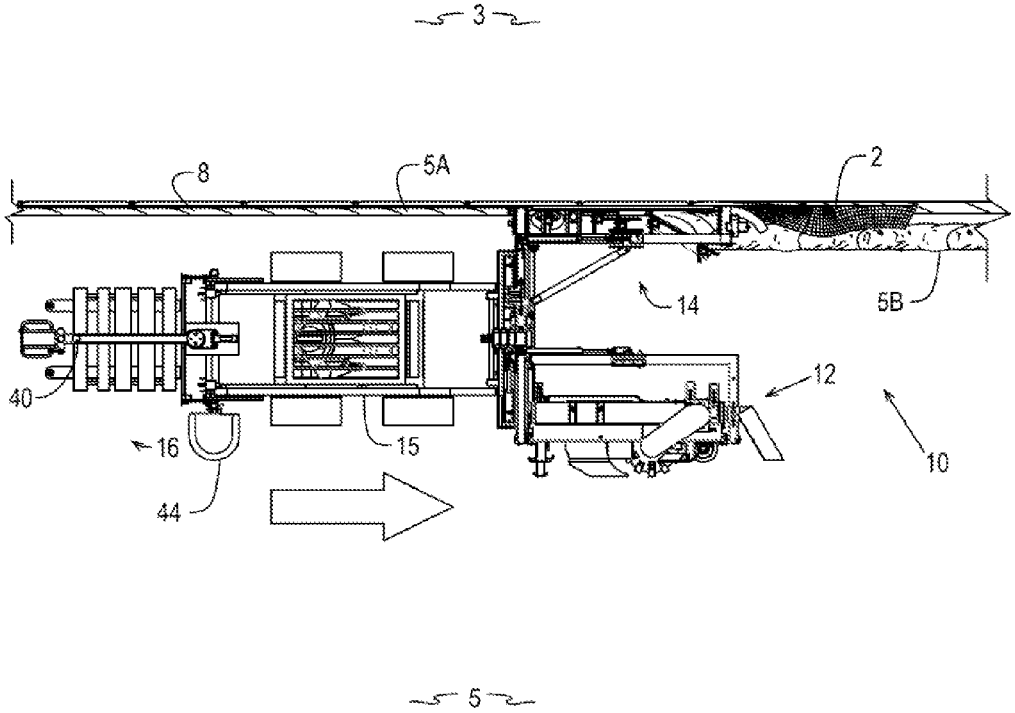
FIG. 2B is a top view of the exemplary silt fence installation equipment performing a backfill operation.

Referring now to FIG. 2B, a top view of silt fence installation equipment 10 is shown. In the depicted configuration, motive vehicle 15 is making a return pass in disturbance zone 5 in the direction of the depicted arrow alongside a silt fence deployed in trench 8. Back filler 14 is deployed, trencher 12 is stowed, and telescoping boom 40 and cradle 44 of second operator station 16 are likewise stowed. Back filler 14 moves soil 5B, which may contain rocks, clods and other material, into trench 8 to form the back fill, breaking up clods and compacting soil 5B so that the bottom of silt fence fabric 2 is secured in trench 8. In both the trenching/fence installing operation depicted in FIG. 2A and the back filling operation depicted in FIG. 2B, silt fence installation equipment 10 remains entirely within disturbance zone 5, which is an advantage, since construction projects frequently do not have permissible disturbance access to protection zone 3. The resulting operation provides minimal or no disturbance of the soil in protection zone 3, since the only contact that is made with the soil in protection zone 3, if any, is the formation of the protection zone-side edge of trench 8, which may result in a small amount of soil being deposited at the top of trench 8 on the side within protection zone 3.

Figure 2C:
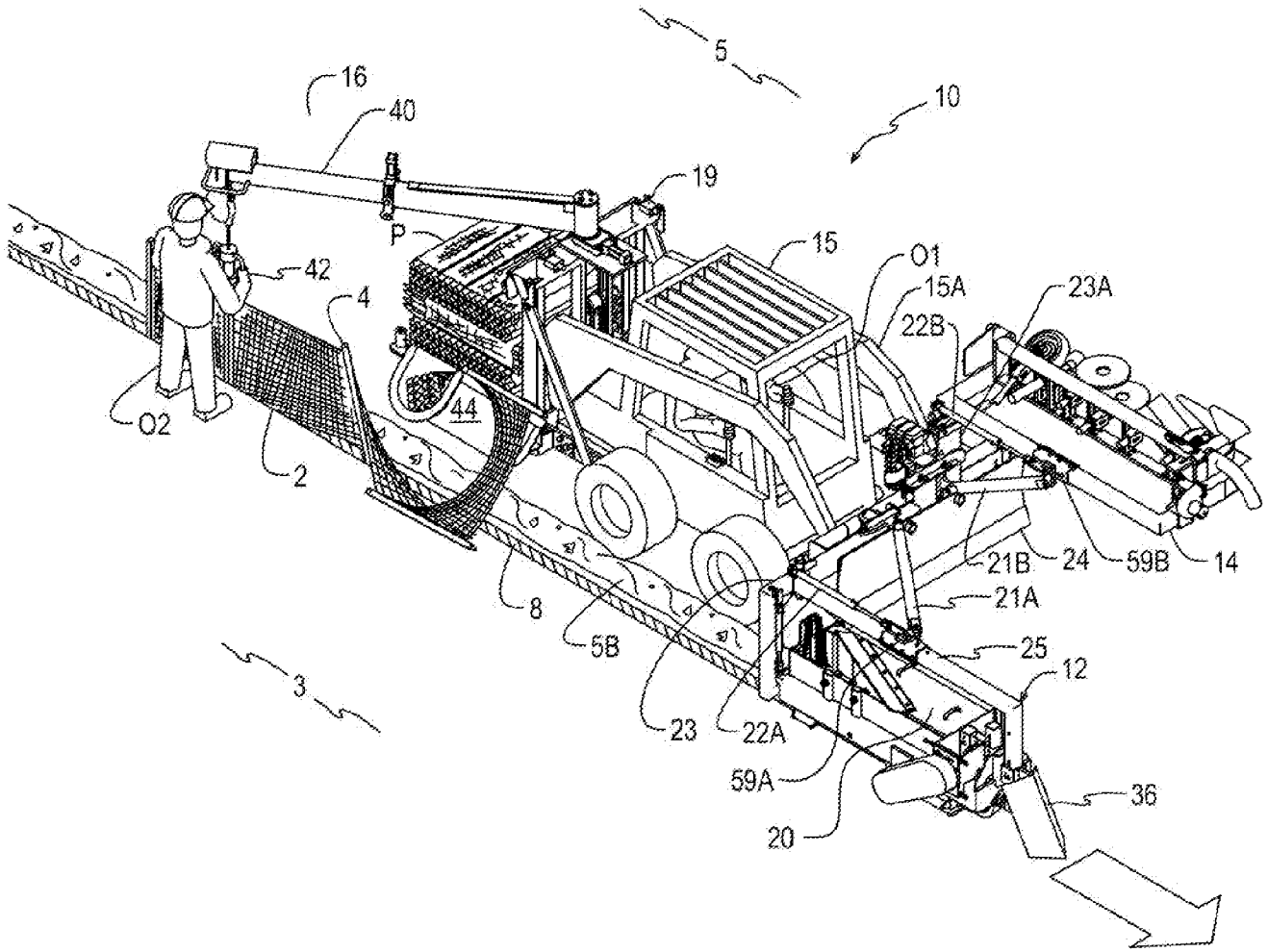
FIG. 2C is a perspective view of the silt fence installation of FIG. 2A

Referring now to FIG. 2C, further details of the trenching and fence installation operation depicted in FIG. 2A is shown in a perspective view and from zone of soil protection 3, as performed by silt fence installation equipment 10. As shown, trencher 12 (in a deployed position) and back filler 14 (in the stowed position) are attached by respective support arms 23, 23A to motive vehicle 15, which may be via their attachment to the frame of an adapter attached to lift arms 15A of motive vehicle 15 as described below or by another suitable linkage to motive vehicle 15. As illustrated, first operator O1 is using trencher 12 to cut trench 8. A stabilizing arm 21A secures trencher 12 in a position determined by a hydraulic actuator 22A that is controlled by first operator O1. Stabilizing arm 21A is attached to a collar 59A that slides along an extension arm 25 of trencher 12, allowing the front end of trencher 12 to move laterally. Details of hydraulic controls and lines are not depicted in the Figures, and it is understood that electric devices or combustion engines and the like can also provide positioning and rotating motive power to the powered devices included in the various portions of silt fence installation equipment 10, as required. Back filler 14, in a manner similar to trencher 12 also has support arm 23A stabilizing arm 21B, a sliding collar 59B and a hydraulic actuator 22B to control lateral position of the front of back filler 14 when back filler 14 is deployed. Trencher 12 includes a cover 20 that prevents debris from being ejected from trencher 12 when trencher 12 is cutting trench 8 and which may assist in the formation of a well-formed row of soil 5B that will later be used for backfilling trench 8. Also attached to a front of motive vehicle 15 is a dozer blade 24 that can simultaneously clear and smooth a region of disturbance zone 5 alongside trench 8. Blade 24 can also assist in maintaining a smooth and/or level elevation variation of trench 8 and consequently the installed silt fence by using blade 24, when needed, to clear larger obstacles before deploying and operating trencher 12 in an area. Trencher 12 also includes a soil deflector 36 that can move above-surface obstacles out of the path of trencher 12.

At second operator station 16, telescoping boom 40 is deployed and is positioned by operator O2 above stakes 4. A power hammer 42, which in the illustrated embodiment is hydraulic, but which may be air-driven, electric or powered by a combustion-driven engine in other configurations, provides an impact to drive stakes 4 into the bottom of trench 8. Prefabricated silt fencing formed by silt fence material and stakes 4 is spooled from cradle 44 as motive vehicle 15 moves forward. Cradle 44 is periodically reloaded by operator O2 from a pallet p loaded onto a lift 19 forming part of second operator station 16.

Figure 2D:
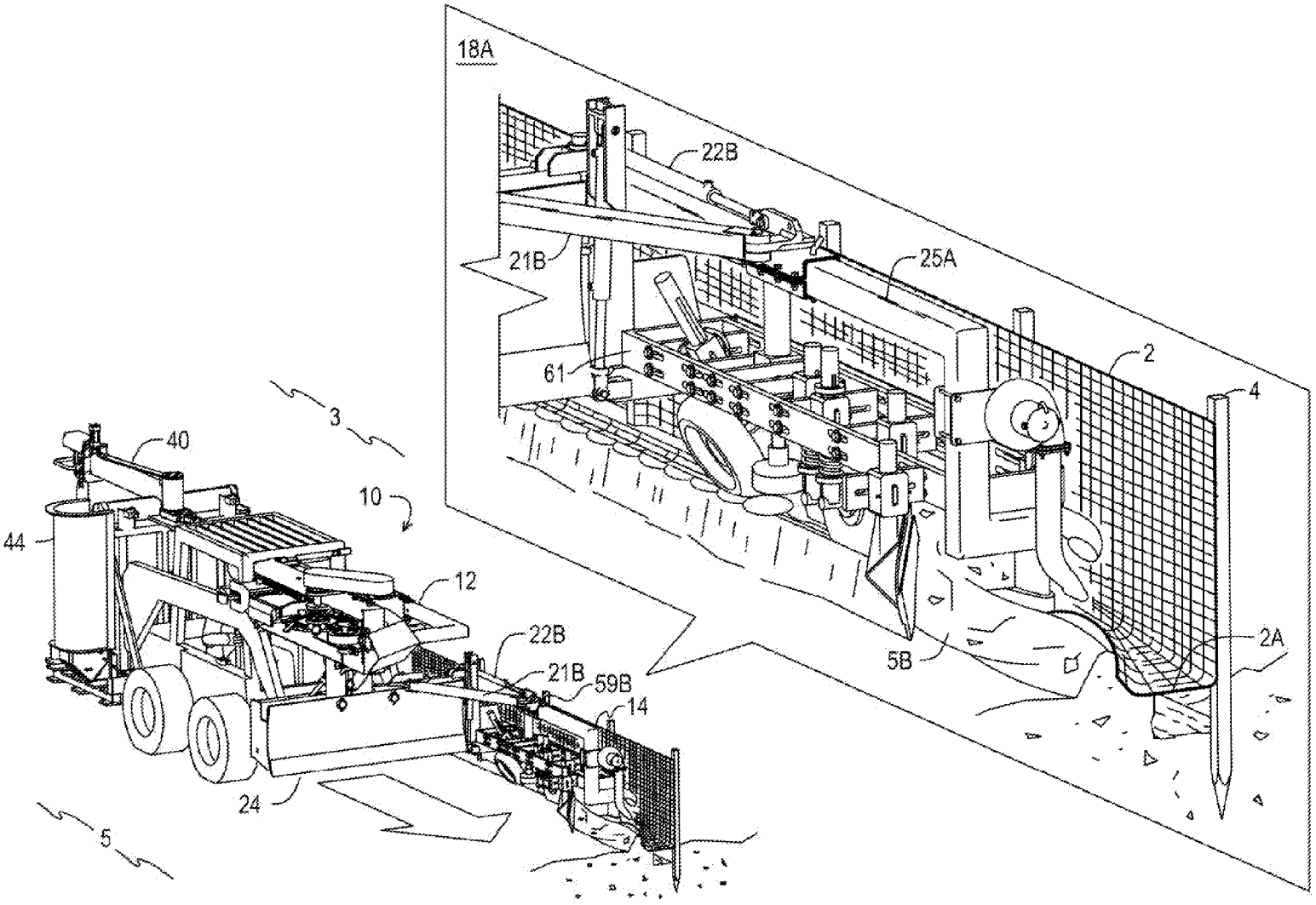
FIG. 2D is a perspective view of the backfill operation of FIG. 2B.

Referring now to FIG. 2D, further details of the back fill operation depicted in FIG. 2B is shown in a perspective view and from disturbance zone 5, as performed by silt fence installation equipment 10. As shown, trencher 12 has been raised and stowed, telescoping boom 40 and cradle 44 are stowed, and back filler 14 is shown in a deployed position. As illustrated, dozer blade 24 can be lowered to follow up behind back filler 14, if back filler 14 is raised and locked in the stowed position. A detail 18A shows some details of back filler 14 that will be described with reference to other Figures below. Soil 5B is moved by back filler 14 atop silt fence fabric bottom portion 2A to form an installation such as that depicted in FIG. 2B.

Figure 2E:
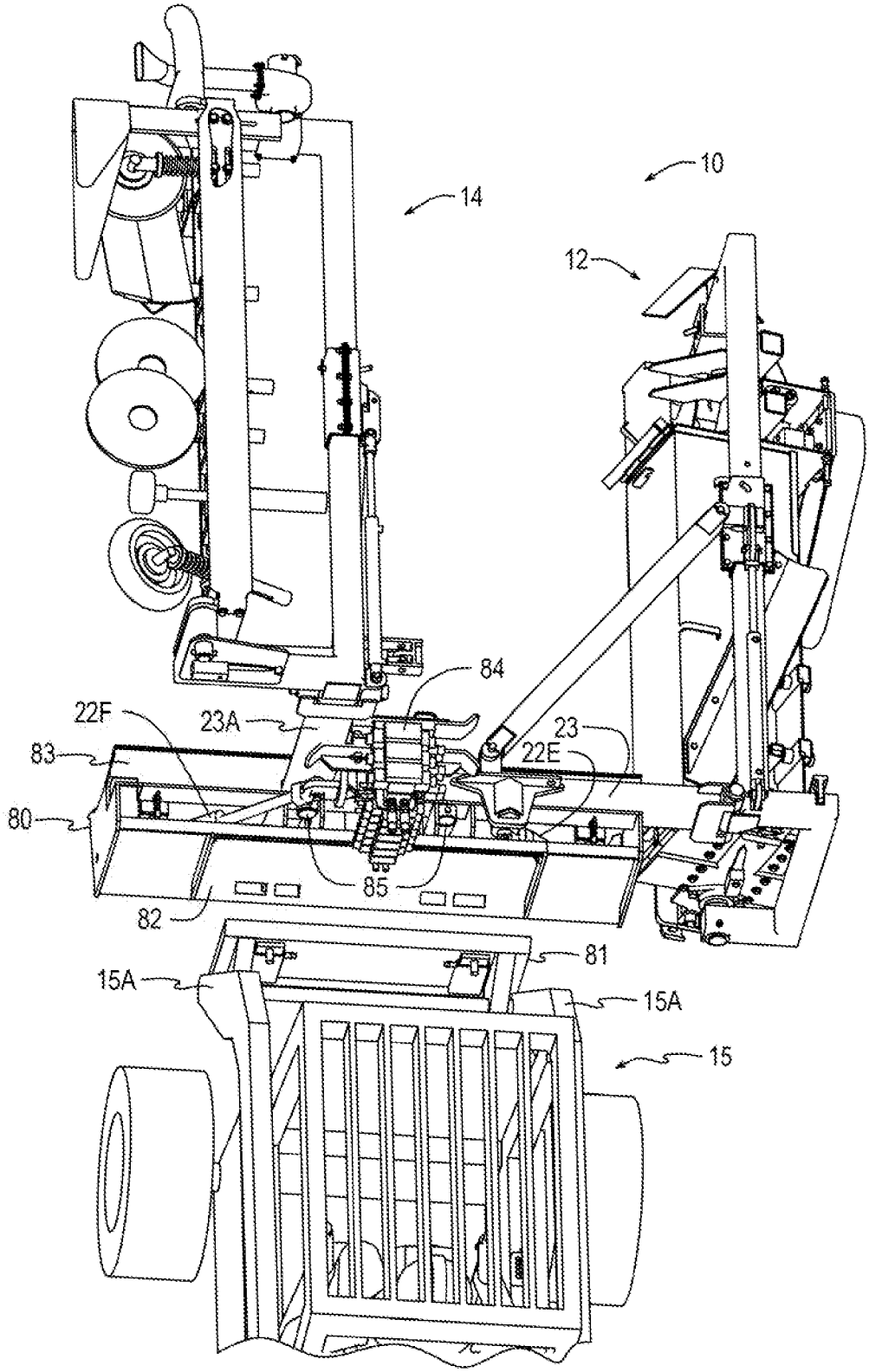
FIG. 2E is a perspective view showing an example of coupling features of motive vehicle 15 and a mounting plate 82 of a frame 80 used to attach trencher 12 and back filler 14 of FIG. 2A to motive vehicle 15.

Referring now to FIG. 2E, a top perspective view of example motive vehicle 15, trencher 12 and back filler 14 shows a frame 80 that includes a mounting plate 82 adapted for coupling to a mounting plate 81 of motive vehicle 15. Mounting plate 81 is connected to lift arms 15A of motive vehicle 15, and as the illustrated example, may be of a standard mounting type, such as a universal skid-steer attachment. Frame 80 includes a channel 83 in which trencher support arm 23 and back filler support arm 23A lie when they are respectively deployed, i.e., in the soil-engaging position. A pair of pins 85 rotatably couple trencher support arm 23 and back filler support arm 23A to frame 80. As illustrated, trencher 12 is deployed, so trencher support arm 23 is disposed in channel 83 and back filler 14 is retracted, so back filler support arm 23A extends upward from channel 83 in a direction perpendicular to channel 83. To provide for deploying and stowing trencher 12 and back filler 14, actuators 22E and 22F, respectively, are operated to extend and retract trencher support 23 and back filler support arm 23A. A wireless remote-operated hydraulic valve stack 84 provides control of actuators 22E and 22F, as well as other actuators within silt fence installation equipment 10 as described herein.

Figure 3A:
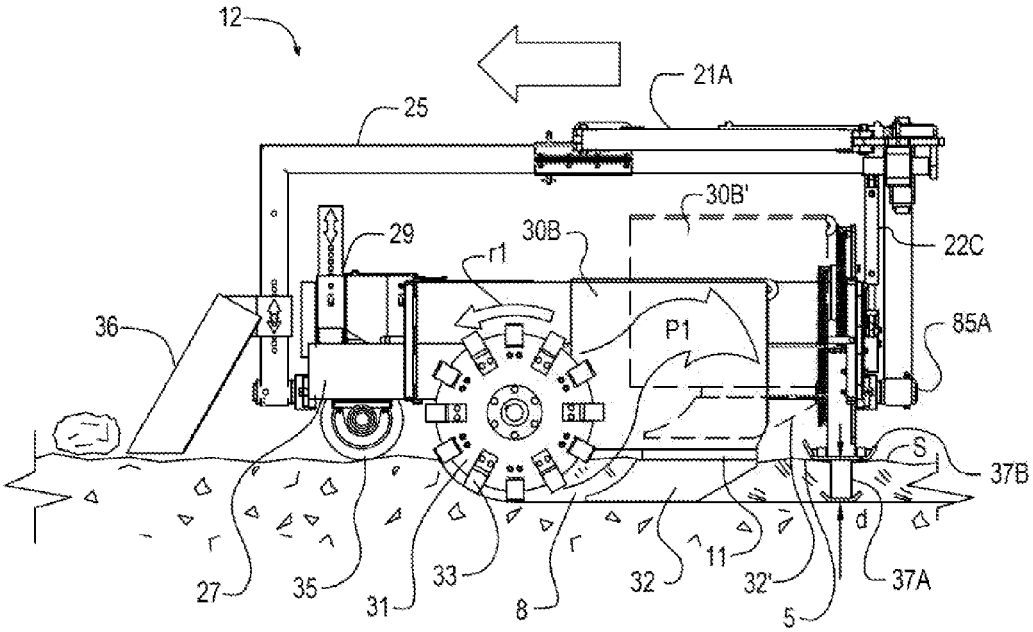
FIG. 3A is a side view depicting details of trencher 12 of FIG. 2A.

Referring now to FIG. 3A, a side view of example trencher 12, as may be included in silt fence installation equipment 10 of FIGS. 2A-2D, is shown with cover 20 removed for clarity. In the depicted configuration, a cutting wheel 31 having teeth 33 suitably shaped to cut a trench of the specified width, cuts into the soil of disturbance zone 5 to a depth that is controlled by a combination of the height set between a reference wheel 35, a reference wheel height adjuster 29 and first operator O1 controlling the elevation of lift arms 15A of motive vehicle 15, and/or controlling a forward aft tilt feature (such as bucket tilt) on the ends of lift arms 15A. The control of the actuators such as lift arms 15A and other actuators that control the position of various features of silt fence installation equipment 10 are by commands that may be electrical, mechanical, hydraulic and may be by direct connection or via wireless remote control. Soil thrown by cutting wheel 31, which normally rotates in a direction r1, is ejected along a debris path P1 and is diverted to the side of trench 8. A trenching foot 32, which is a rigid form having a cross-section substantially that of the desired trench dimensions, is positioned at a bottom of a range of travel of trenching foot 32. Trenching foot 32 has a curved front surface that lifts loosened soil within trench 8 up and out into debris path P1 where it is deflected by a soil deflector 30B to form a pile extending adjacent to the top of trench 8. Trenching foot 32 is mounted to the bottom of soil deflector 30B and the resulting assembly is spring loaded and is permitted to move vertically with respect to a trencher frame 27 to which other components of trencher 12 are connected so that at commencement of trenching or when a large obstacle is encountered, trenching foot 32 and soil deflector 30B can move to an upward position. Dashed lines show an upper end of the range of travel of trenching foot 32 as a trenching foot/soil deflector outline 32'. Trenching foot 32 moves parallel to the plane of trencher frame 27 so that the entire bottom of trenching foot 32 moves along the bottom of trench 8 under stable trenching conditions, in order to produce a trench having a flat bottom of specified depth. One or more spacers 11 of various thicknesses can be inserted between soil deflector 30B and trenching foot 32 to adjust the position of trenching foot 32 with respect to the maximum bottom extension of teeth 33, so that a cutting wheel 31 of greater diameter (including teeth 33) can be installed. The use of spacers permits the relationship between the bottommost extension of teeth 33 cutting wheel 31 and the bottom of trenching foot 32 to be maintained, so that trenching foot 32 will contact the bottom of trench 8. Trenching feet of different widths can be substituted for trenching foot 32 for forming a narrower or wider trench 8. The speed and direction of rotation of cutting wheel 31 can also be operator controlled, in order to handle various soil conditions.

Depth d of trench 8 is measured by a first gauge foot 37A that rides along the bottom of trench 8, and provides a visual indication of trench depth d by controlling an indicator, as will be described in further detail below. The measured trench depth d is relative to soil surface S, as measured by a second gauge foot 37B through which first gauge foot 37A slides, and which is wider than trench 8, so that second gauge foot 37B slides along surface S. A rotation of trencher frame 27 around an axis of a pin 85A with respect to extension arm 25 is controlled by a hydraulic actuator 22C. Rotation of trencher frame 27 also rotates active components of trencher 12, i.e., cutting wheel 31, trenching foot 32 and soil deflector 30B, as well as other components of trencher 12. Hydraulic actuator 22C is in turn controlled by operator O1 to maintain a true plumb orientation of trencher frame 27 to maintain the cutting components plumb to the earth, i.e., so that the sides of trench 8 are vertical with respect to gravity. While hydraulic actuator 22C is a linear actuator, in alternative embodiments, a rotational actuator such as an electric motor and gearbox may be used to rotate trencher frame 27 with respect to extension arm 25.

Figure 3B:
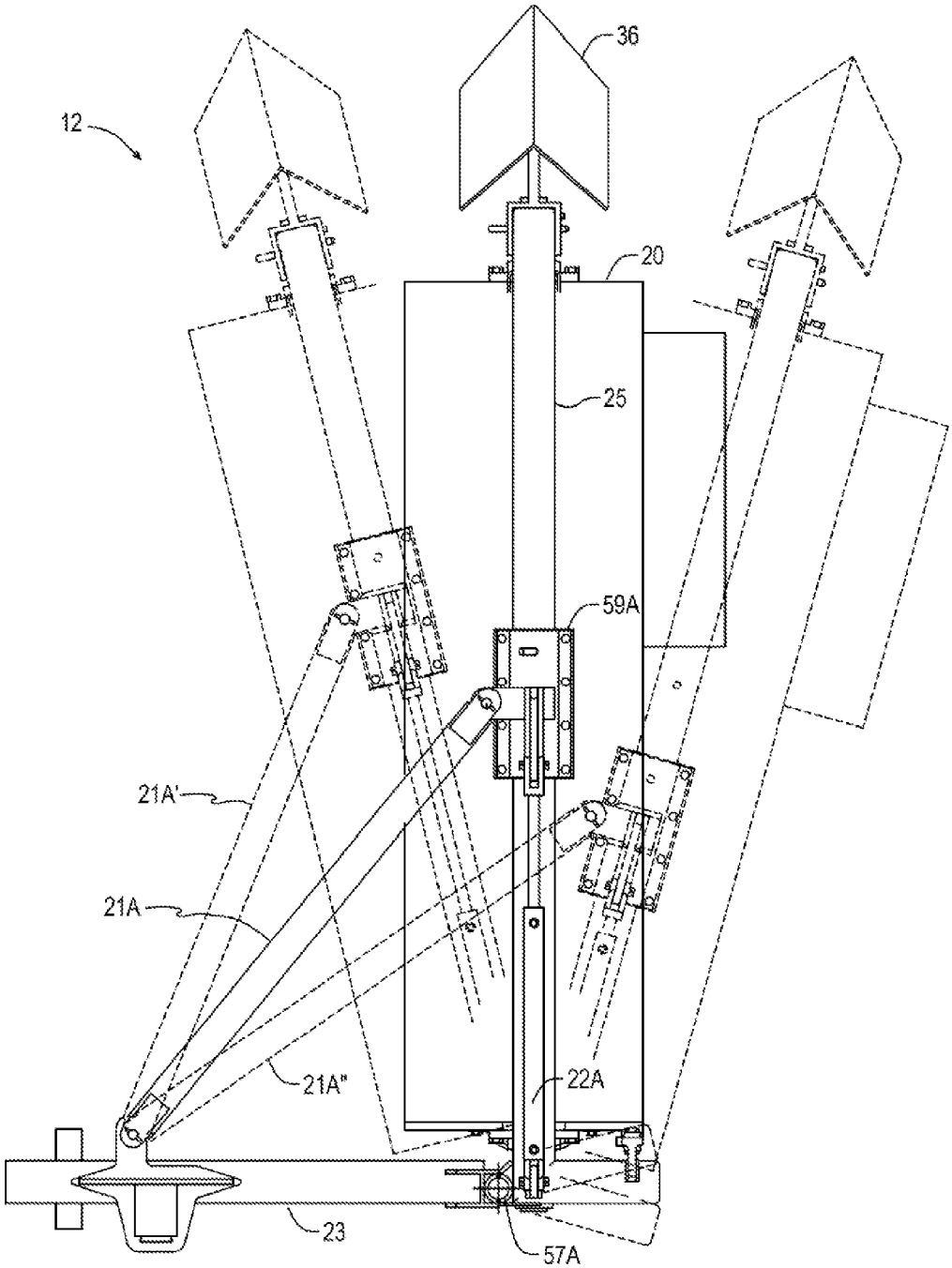
FIG. 3B is a top view depicting details of positioning arm 22A of FIG. 3A.
Figure 3C:
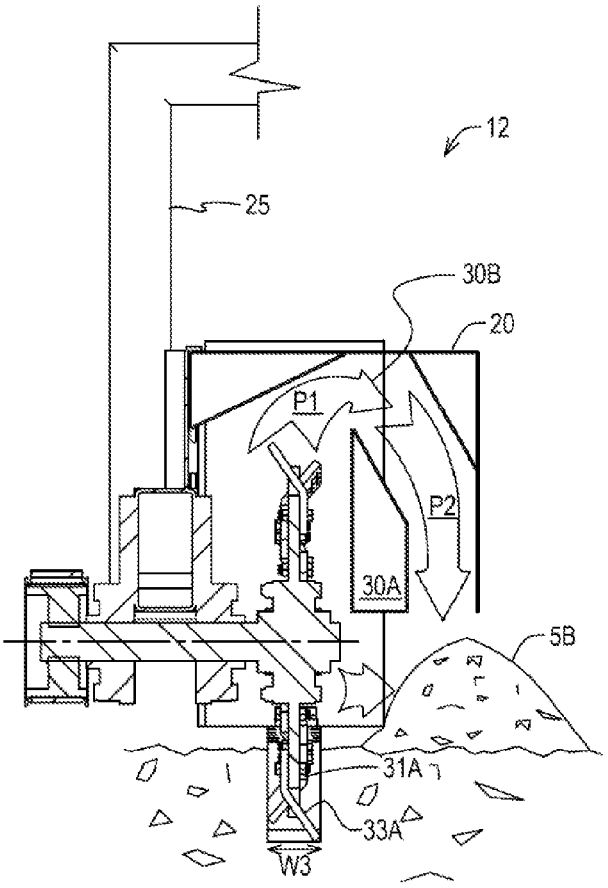
FIG. 3C is an end cross-section view depicting details of a trencher 12A that can be used to implement trencher 12 of FIG. 2A.
Figure 3D:
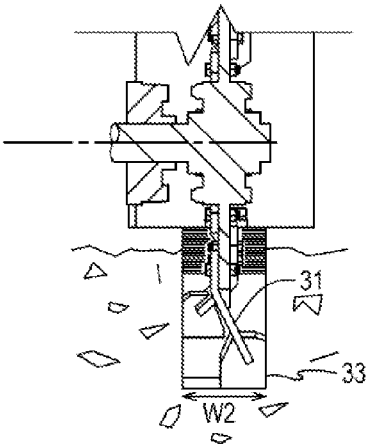
FIG. 3D is an end cross-section view depicting details of another trencher 12B that can be used to implement trencher 12 of FIG. 2A.

Referring now to FIG. 3B, lateral movement of trencher 12 as controlled by hydraulic actuator 22A is illustrated. Hydraulic actuator 22A retracts and extends collar 59A with respect to trencher support arm 23, which causes extension arm 25 to pivot laterally around a pin 57A, with the extreme positions illustrated as lateral arm positions 21A' and 21A". Referring to FIG. 3C and FIG. 3D, two different types of cutting wheel are illustrated. In FIG. 3C, a narrow cutting wheel 31A having teeth 33A extending across a width $w_3$ such as would be suitable for cutting trench 8B of FIG. 1C. FIG. 3C also illustrates the movement of soil 5B under cover 20 and along soil paths P1 and P2 as deflected by cover 20 and by soil deflectors 30A and 30B. FIG. 3D illustrates wider cutting wheel 31, having teeth 33 that are bladed to extend to a width $w_2$ such as would be suitable for cutting trench 8A of FIG. 1B.

Figure 3E:
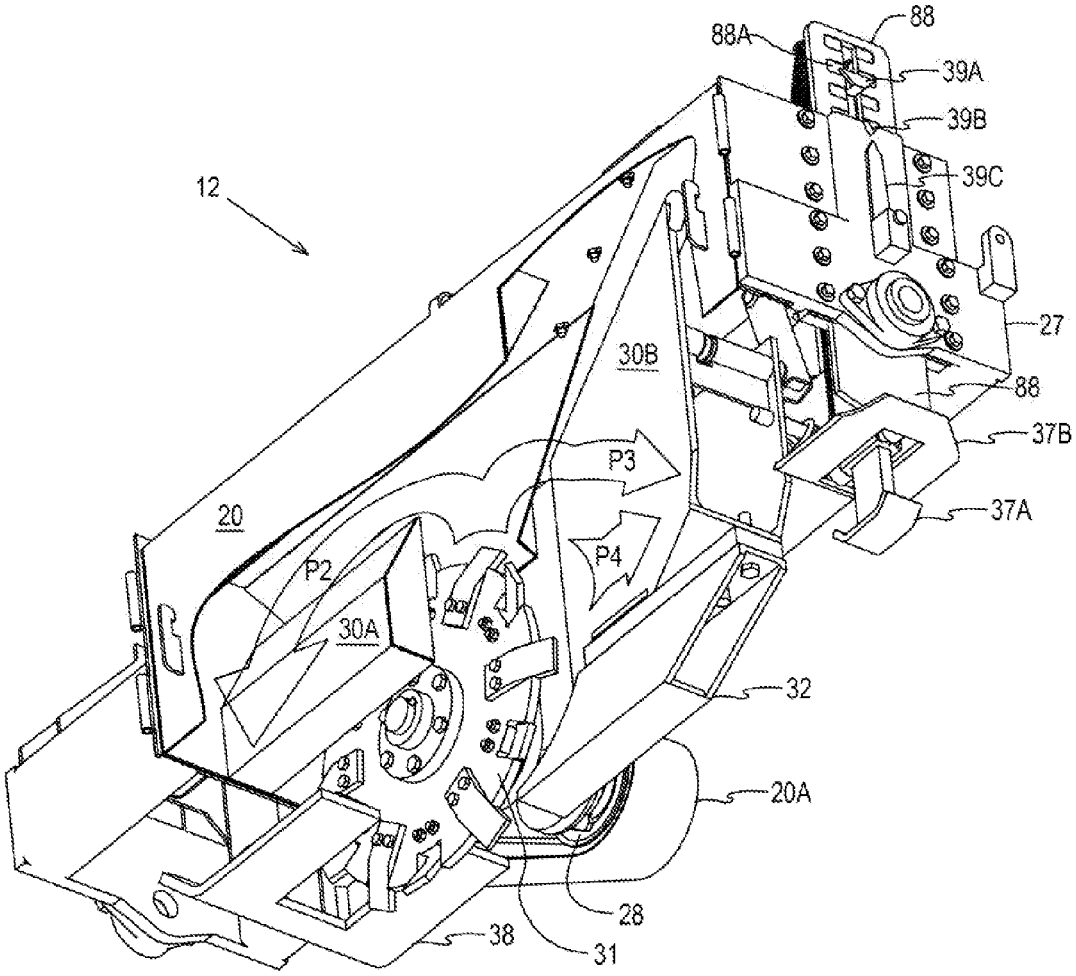
FIG. 3E is bottom perspective view depicting details of trencher 12 of FIG. 2A.

Referring now to FIG. 3E, further details of trencher 12 are shown in a perspective bottom view. First operator O1 receives feedback about the depth of the trench via the position of a trench depth indicator 39A, which is rigidly coupled to first gauge foot 37A. Trench depth indicator 39A operates in reference to a depth scale 88A provided on a gauge frame 88 that is rigidly coupled to second gauge foot 37B. Trench depth indicator 39A and depth scale 88A thus provide a relative measurement of trench depth with respect to the immediately surrounding terrain. Another (plumb) indicator 39C is rotatably mounted to trencher frame 27 and remains aligned with plumb, since the bottom of plumb indicator 39C is weighted so that plumb indicator 39C points upwards when trencher frame 27 is plumb. Plumb indicator 39C provides first operator O1 an indication of the alignment of trencher frame 27 (FIG. 3A), on which reference indicator 39B is mounted, and the direction of plumb, to which plumb indicator 39C points. First operator O1, by altering the rotation of trencher frame 27 via hydraulic (or optionally electrical) control of actuator 22C can maintain the orientation of trencher 12 with respect to plumb by aligning plumb indicator 39C and reference indicator 39B and maintain a specified depth of trench 8 by maintaining a predetermined position of trench depth indicator 39A along scale 88A. FIG. 3E illustrates other features such as the hollow rear end of trenching foot 32 which allows for removal and re-attachment of spacers and different trencher feet, and additional soil paths P3 and P4 that extend across soil deflector 30B. FIG. 3E also clarifies not only how soil ejected by cutting wheel 31 is moved to the side of trench 8 along soil path P3, but that soil that rises across the leading surface of trenching foot 32 is lifted to soil path P4 and ejected. FIG. 3E also illustrates a sled 38 that may be optionally provided in place of reference wheel 35 and attached for use in such conditions as thick grass that might otherwise tangle and block the operation of cutting wheel 31. In such an embodiment, the U-shaped pattern of contact between surface S and sled 38 will hold down material such as grass and other material on surface S so that the material is less likely to become wrapped around cutting wheel 31, and so that the material can be cut by cutting wheel 31 and does not remain dangling within or across trench 8. A drive cover 20A covers the connection of cutting wheel 31 via a pulley 28 or alternatively via chain to a drive motor, which may be electric, hydraulic, mechanically coupled to an engine of motive vehicle 15 or may be a separate combustion engine. The drive motor may alternatively be directly coupled to cutting wheel 31.

Figure 3F:
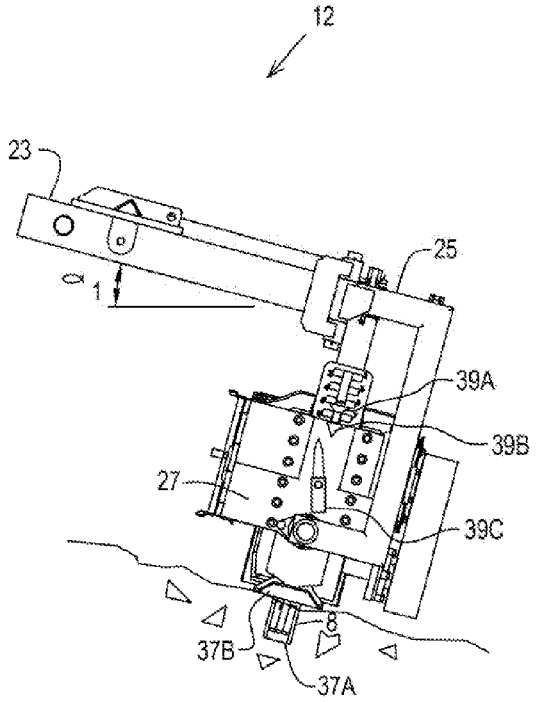
FIG. 3F is a rear view depicting details of trencher 12 of FIG. 2A operating at a first inclination and FIG. 3G is a rear view depicting details of trencher 12 of FIG. 2A operating at a second inclination.
Figure 3G:
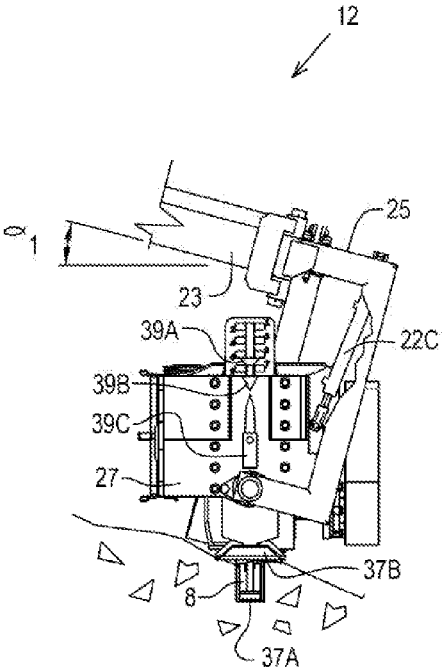

Referring now to FIG. 3F and FIG. 3G, the alignment of reference indicator 39B and plumb indicator 39C is illustrated for a condition in which trencher 12 is not cutting a truly vertical trench (i.e., a trench with sides on true plumb to gravity). In FIG. 3F, the terrain is sloped at an angle $\alpha_1$ but extension arm 25 and trencher frame 27 are parallel to the terrain. Therefore, there is a deviation of $\alpha_1$ between plumb indicator 39C and reference indicator 39B. FIG. 3G illustrates a properly plumb trench that is cut once hydraulic actuator 22C is moved to rotate trencher frame 27 with respect to the movement path of motive vehicle 15 as described above, so that plumb indicator 39C and reference indicator 39B are aligned. In FIG. 3G, trencher frame 27, and thus the active trench-cutting components of trencher 12, e.g., cutting wheel 31, trenching foot 32 are aligned to plumb. While not all silt fence installations require that silt fence be installed vertically, the combination of plumb indicator 39C and reference indicator 39B makes it possible to maintain a plumb (or other specified) orientation while cutting trench 8 by operator O1 controlling hydraulic actuator 22C.

Figure 3H:
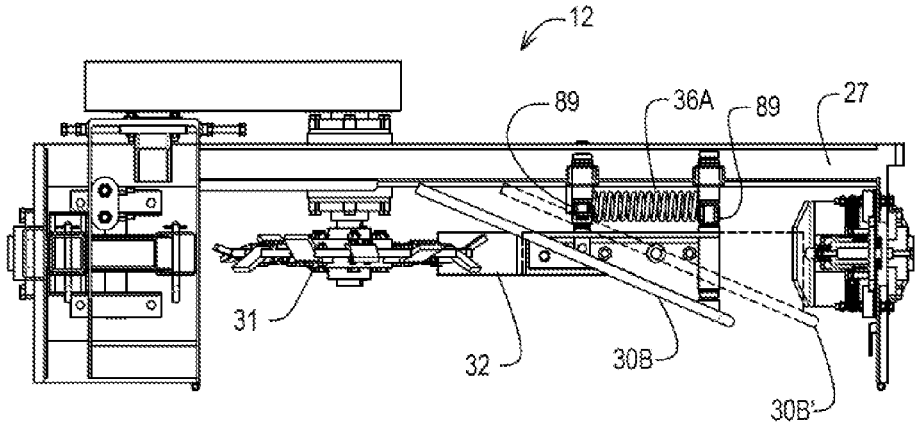
FIG. 3H is a top view of trencher 12 of FIG. 2A with cover 20 removed.
Figure 3I:
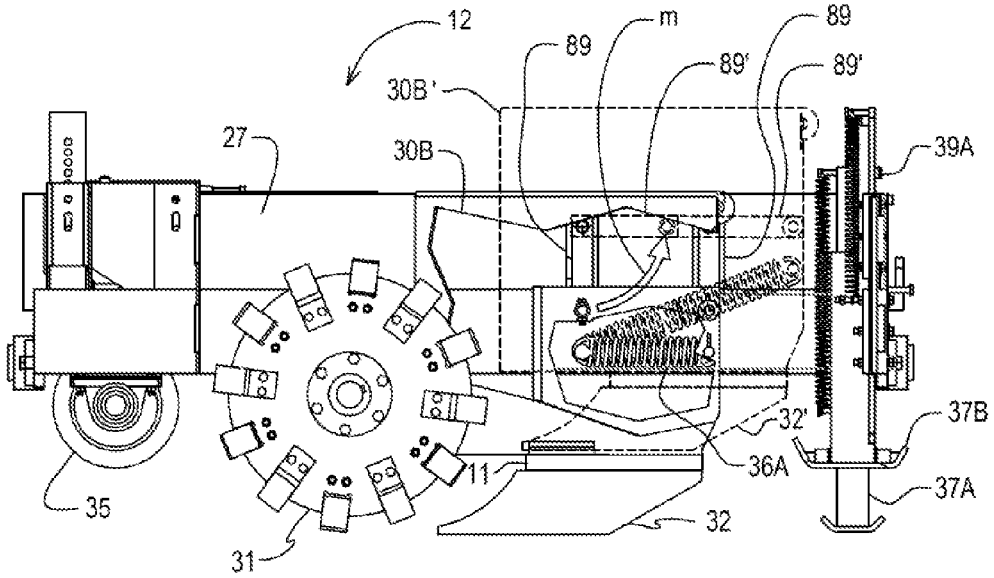
FIG. 3I is a side view with cover 20 removed and soil deflector 30B cut-away, depicting details of trencher 12 of FIG. 2B.

Referring now to FIG. 3H and FIG. 3I, a top view and a side view of trencher 12 are shown with cover 20 removed. A spring 36A that pre-loads the assembly formed by trenching foot 32, spacer 11 and soil deflector 30B can be seen. Spring 36A pulls trenching foot 32 downward to form trench 8, but permits trenching foot 32 to start above ground and to ride over significant obstacles in trench 8. Movement of soil deflector 30B, trenching foot 32 and spacer 11 is controlled by two parallel swing arms 89 that are rotatably coupled to trencher frame 27 and soil deflector 30B so that trenching foot 32 remains parallel to the bottom of trench 8, even when raised. As in FIG. 3A, the extremes of movement of trenching foot 32 along movement path m are shown using a dashed line for the extreme upper (raised) position, including the movement of soil deflector 30B, trenching foot 32, swing arms 89 and spacer 11, with the extreme (raised) position of swing arms 89 illustrated as an outline 89'. FIG. 3H shows soil deflector 30B at the in-trench position, with the extreme (raised) position of soil deflector 30B illustrated as outline 30B'.

Figure 3J:
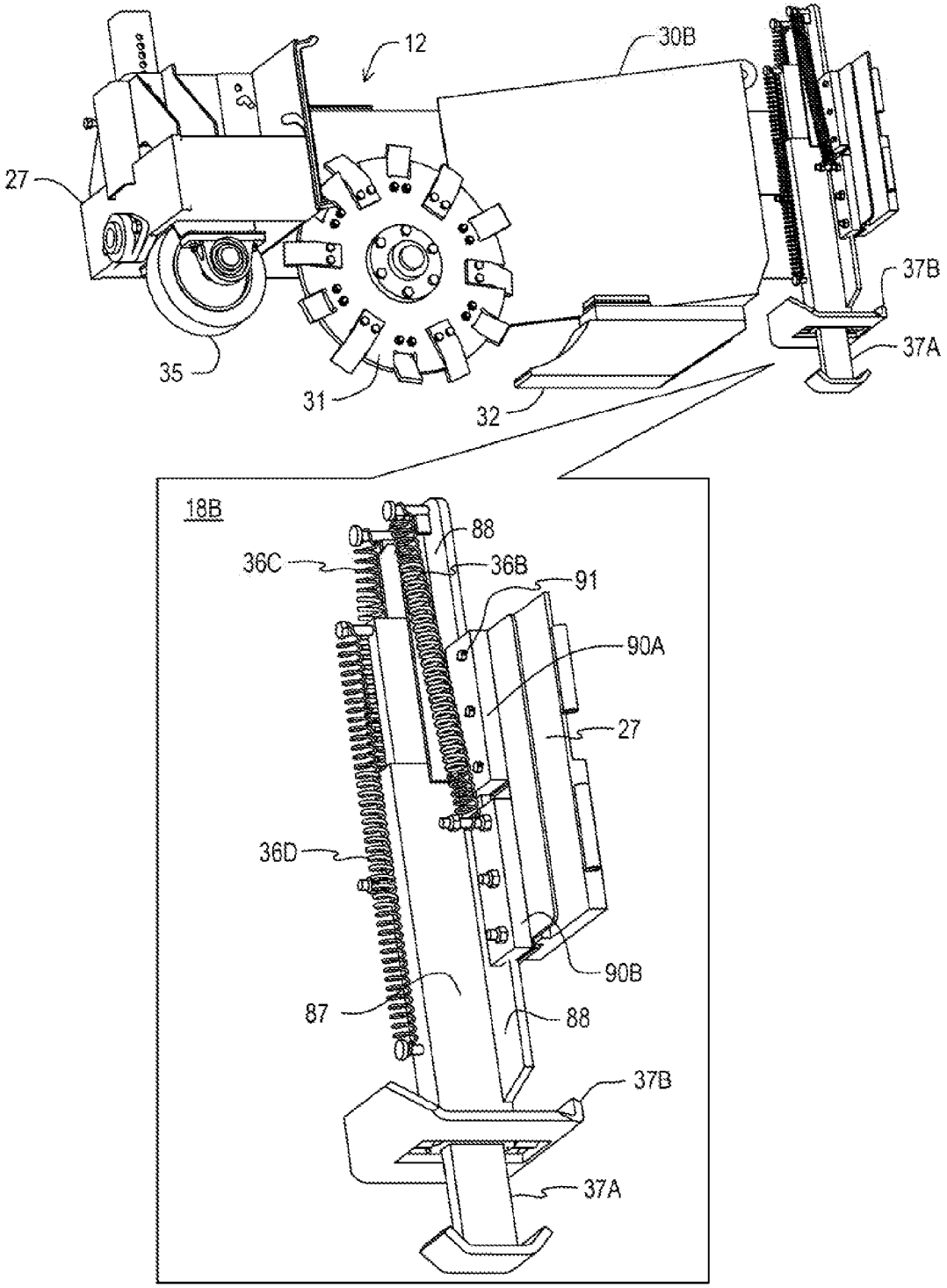
FIG. 3J is a forward side perspective view.
Figure 3K:
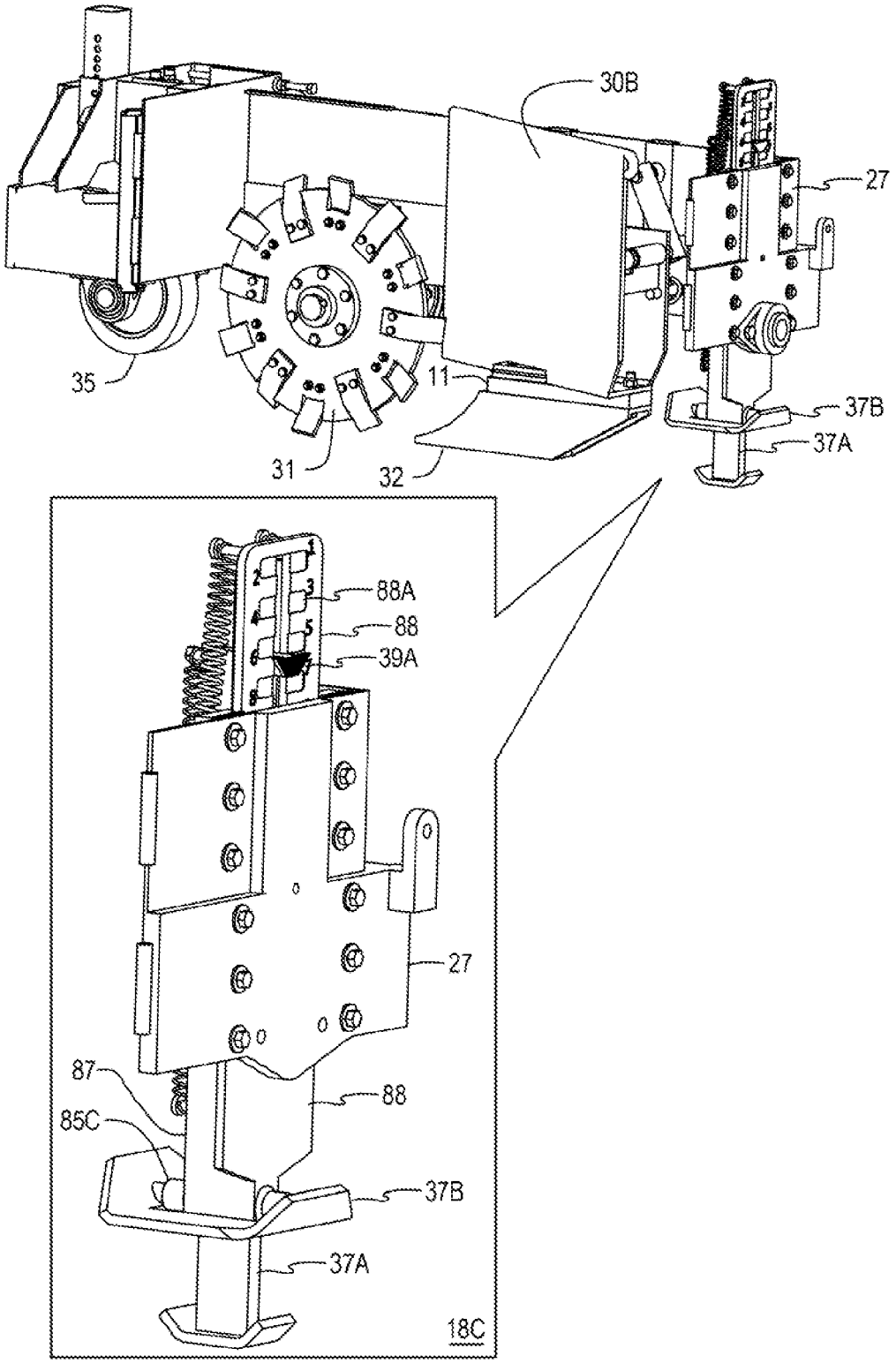
FIG. 3K is a rearward side perspective view, depicting details of trencher 12 of FIG. 2A with cover 20 removed.

Referring now to FIG. 3J and FIG. 3K, two different side perspective views of trencher 12 are shown with cover 20 removed. A detail 18B illustrates the spring loading arrangement for first gauge foot 37A by a spring 36D, which connects a top end of an upward extension of first gauge foot 37A to a hollow channel member 87 to which second gauge foot 37B is rotatably coupled by a pin 85C as shown in detail 18C of FIG. 3K, permitting second gauge foot 37B to tilt to match differences between surface S and the bottom of trench 8. Hollow channel member 87 is rigidly attached, e.g., by welding or mechanical fasteners, to gauge frame 88. The upward extension of first gauge foot 37A slides within an interior of hollow channel member 87 to move depth indicator 39A along scale 88A according to the contact of the bottom of first gauge foot 37A with the bottom of trench 8. The assembly formed by gauge frame 88, hollow channel member 87, first gauge foot 37A, second gauge foot 37B and spring 36D is slidably coupled to trencher frame 27 by fixed slide blocks 90B affixed to trencher frame 27 on each side of gauge frame 88 and locking slide blocks 90A loosely coupled to trencher frame 27 on each side of gauge frame 88. Bolts 91 that retain locking slide blocks 90A can be tightened to prevent movement of the assembly formed by gauge frame 88, hollow channel member 87, first gauge foot 37A, second gauge foot 37B and spring 36D with respect to trencher frame 27. When bolts 91 are tightened, depth indicator 39A indicates the depth of trench 8 with respect to trencher frame 27 and second gauge foot 37B does not move up and down with respect to trencher frame 27. When bolts 91 are loosened such that second gauge foot 37B can follow the height of surface S, depth indicator 39A indicates the difference in height between first gauge foot 37A and second gauge foot 37B, providing a direct measurement of the instant depth of trench 8 as trencher 12 is operated. Springs 36B and 36C pull gauge 88 frame downward, so that when bolts 91 are loosened, second gauge foot 37B is pushed down to contact the ground above trench 8.

Figure 4A:
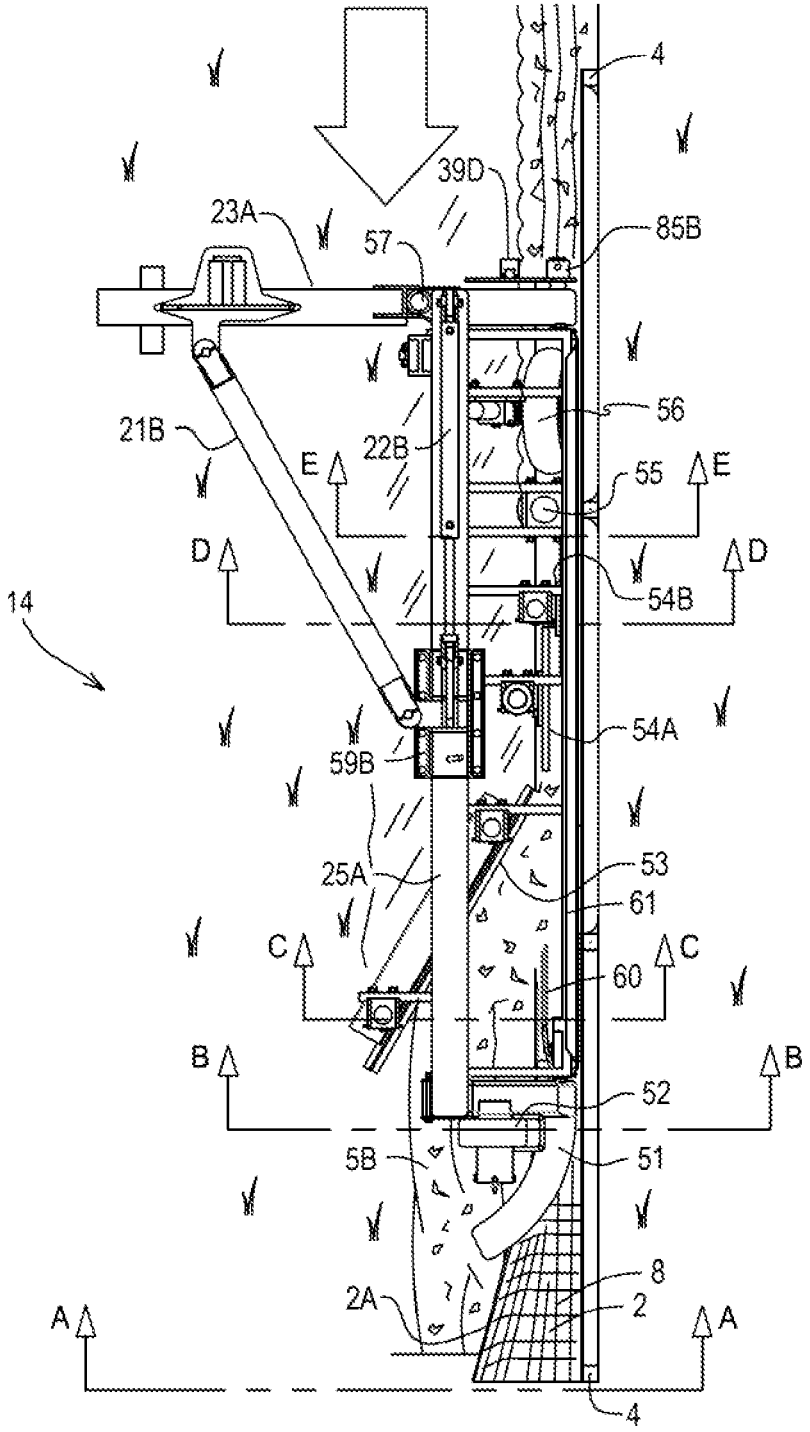
FIG. 4A is a top view depicting details of back filler 14 of FIG. 2A.
Figure 4B:
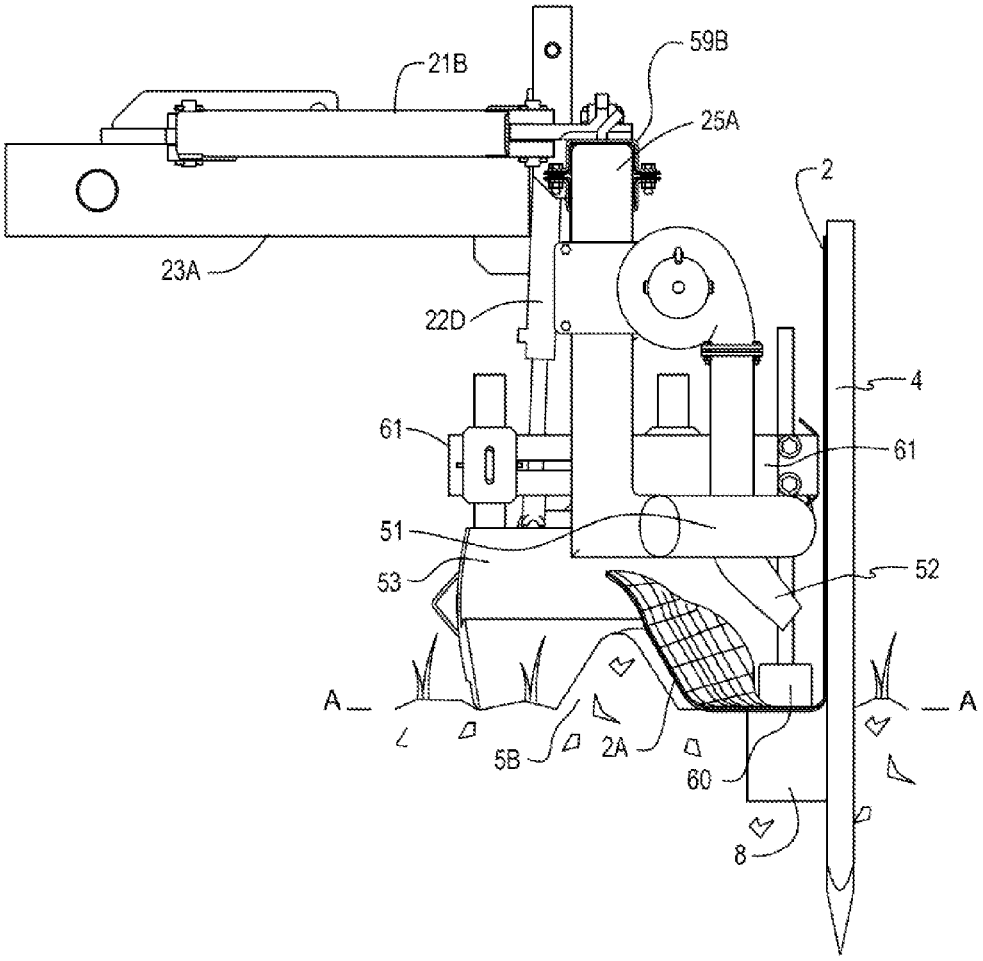
FIGS. 4B-4F are section views of back filler 14 of FIG. 4A.

Referring now to FIG. 4A, a top view of back filler 14, as may be included in silt fence installation equipment 10 of FIGS. 2A-2D, is shown performing a back fill operation moving in the direction of the depicted arrow. FIG. 4A indicates sections A-A through E-E, which will be described in the following Figures. In the depicted configuration, back filler 14 includes an extension arm 25A along which sliding collar 59B slides according to a position of hydraulic actuator 22B. Stabilizing arm 21B moves with sliding collar 59B and positions back filler 14 laterally according to the position of hydraulic actuator 22B as back filler extension arm 25A rotates around a pin 57. Various fixtures as described below are affixed to a back filler frame 61 that provides adjustable mounts, or alternatively fixed mounting locations for the various fixtures/attachments that perform portions of the backfill operation as described below. Back filler frame 61 is rotatably coupled to back filler extension arm 25A by pins 85B, details of which are illustrated in the alternative embodiment of back filler 14A in FIGS. 6A-6B, so that the alignment of back filler frame 61 with respect to the inclination of soil S can be controlled to provide the best back fill result. The inclination of frame 61 may be controlled with respect to plumb, or frame 61 may be inclined to match the tilt of soil S as needed. An inclination indicator 39D provides a visual indication to operator O1 of the orientation of back filler frame 61 with respect to back filler extension arm 25A. A hydraulic actuator 22D, as shown in FIG. 4B, provides for control of the tilt of back filler frame 61 with respect to back filler extension arm 25A. As the backfill operation proceeds, silt fence bottom portion 2A and trench 8 encounter a variety of backfill attachments, which can be interchanged and positioned along back filler 61 as needed to meet the requirements for the shape of trench 8, as well as other considerations. Continuous positioning and interchange can be provided by sliding clamps, or multiple mounting positions can be alternatively provided along back filler frame 61.

As shown, back filler 14 includes a guide bar 51 that contacts silt fence fabric 2 and starts guiding silt fence fabric 2 and stakes 4 into position with respect to back filler frame 61, a blower 52 that provides a continuous stream of air to hold silt fence fabric 2 against stakes 4 while a fabric guide 60 guides silt fence fabric bottom portion 2A to the bottom of trench 8. In other embodiments, blower 52 might be supplemented with additional guide bars and/or wheels that contact silt fence fabric 2 to position silt fence fabric bottom portion 2A during the back fill operation. A blade 53 moves the pile of soil 5B into trench 8 atop silt fence fabric bottom 2A and discs 54A and 54B break up voids and clods. Disc 54B may have a cup-shaped profile and have a trailing edge turned toward trench 8 in order to move any remaining soil 5B toward silt fence fabric 2. A power tamper 55 packs backfilled soil 5B into trench 8 and a finishing wheel 56 smoothes the top surface of the backfilled soil 5B.

FIG. 4B is a cross-section view of section A-A of FIG. 4A. Silt fence fabric bottom portion 2A is shown as formed by blower 52 against stakes 4 and across a top of trench 8 as silt fence fabric bottom portion 2A begins to engage with fabric guide 60. While guide bar 51 is not shown as contacting silt fence fabric 2 for clarity, if silt fence fabric 2 moves away from above trench 8, guide bar 51 will engage silt fence fabric 2 and permit blower 52 and fabric guide 60 to engage silt fence fabric bottom portion 2A properly.

Figure 4C:
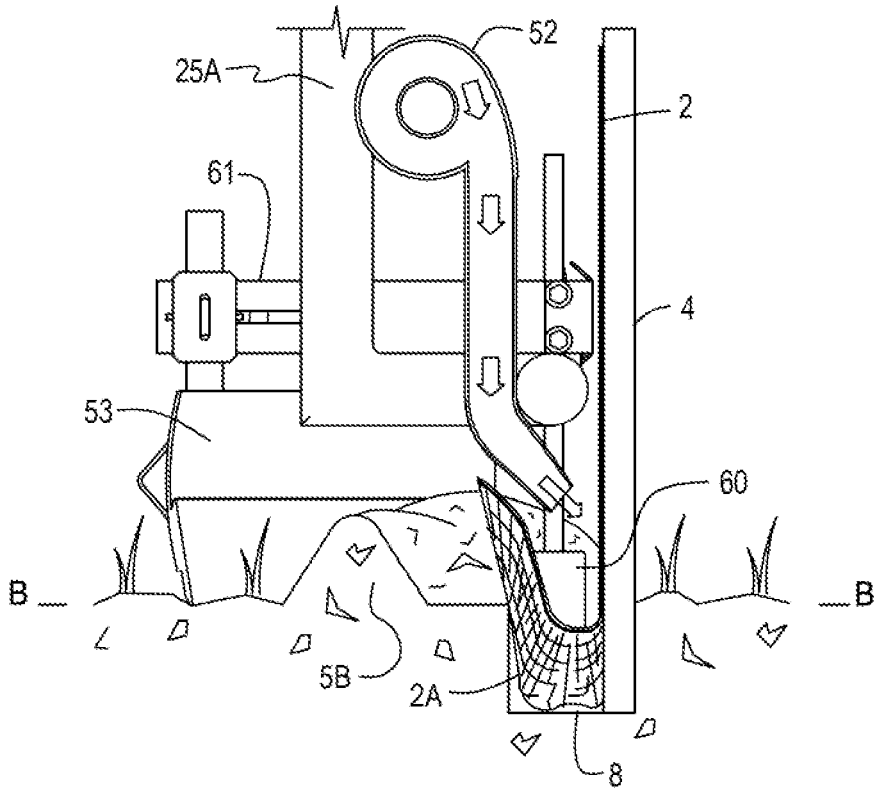
Figure 4D:
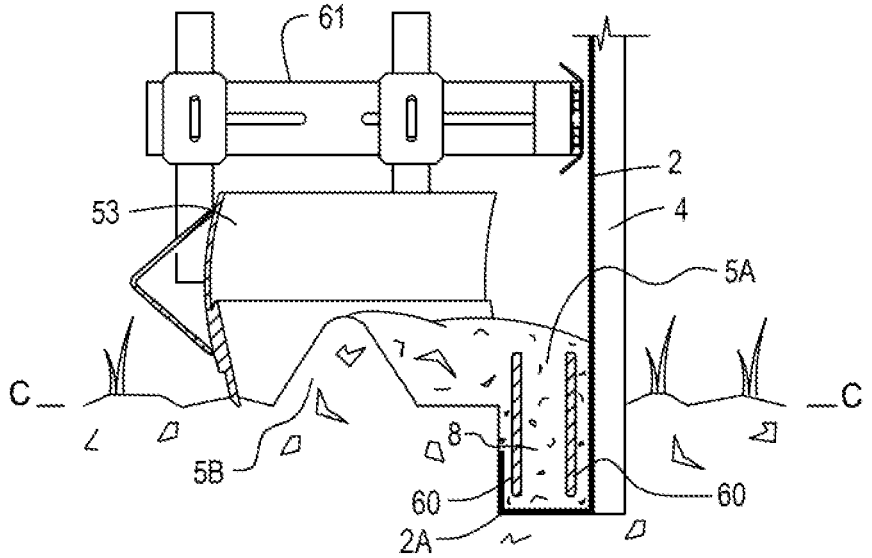
Figure 4E:
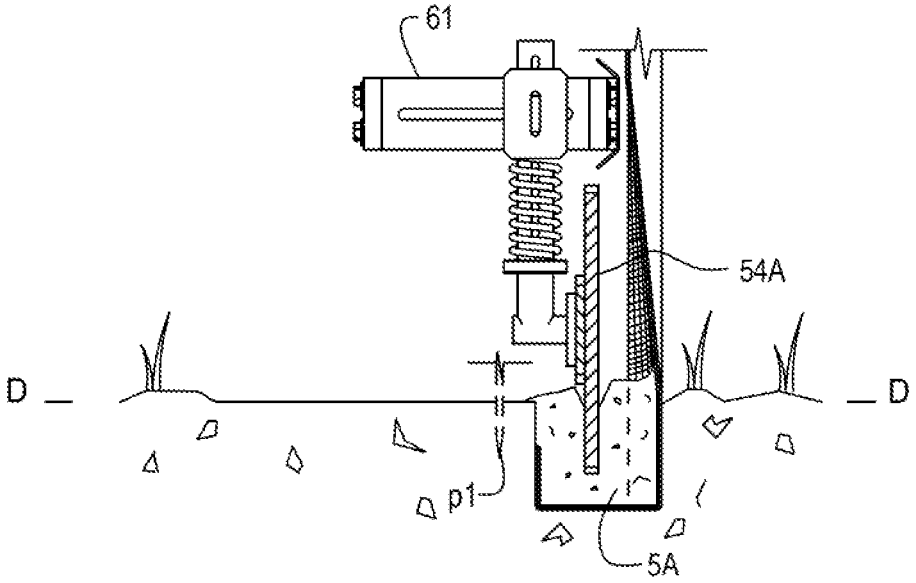

FIG. 4C is a cross-section view of section B-B of FIG. 4A. Fabric guide 60 moves silt fence fabric bottom portion 2A downward toward the bottom of trench 8. FIG. 4D is a cross-section view of section C-C of FIG. 4A. Fabric guide 60 now holds silt fence fabric bottom portion 2A in the bottom of trench 8, while blade 53 moves soil 5B into trench 8. FIG. 4E is a cross-section view of section D-D of FIG. 4A.

Figure 4F:
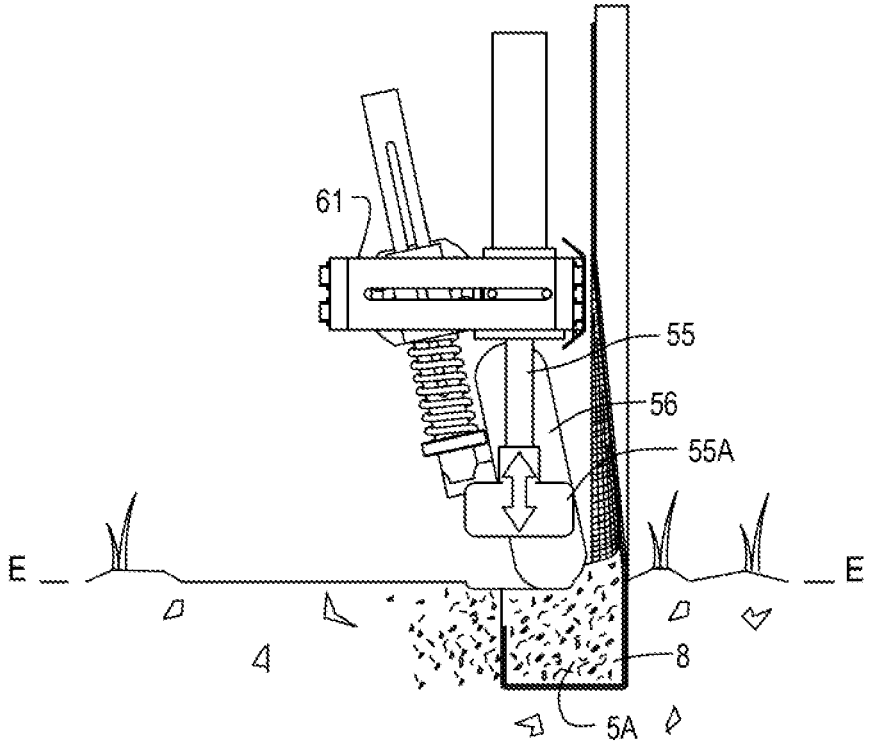
Figure 5:
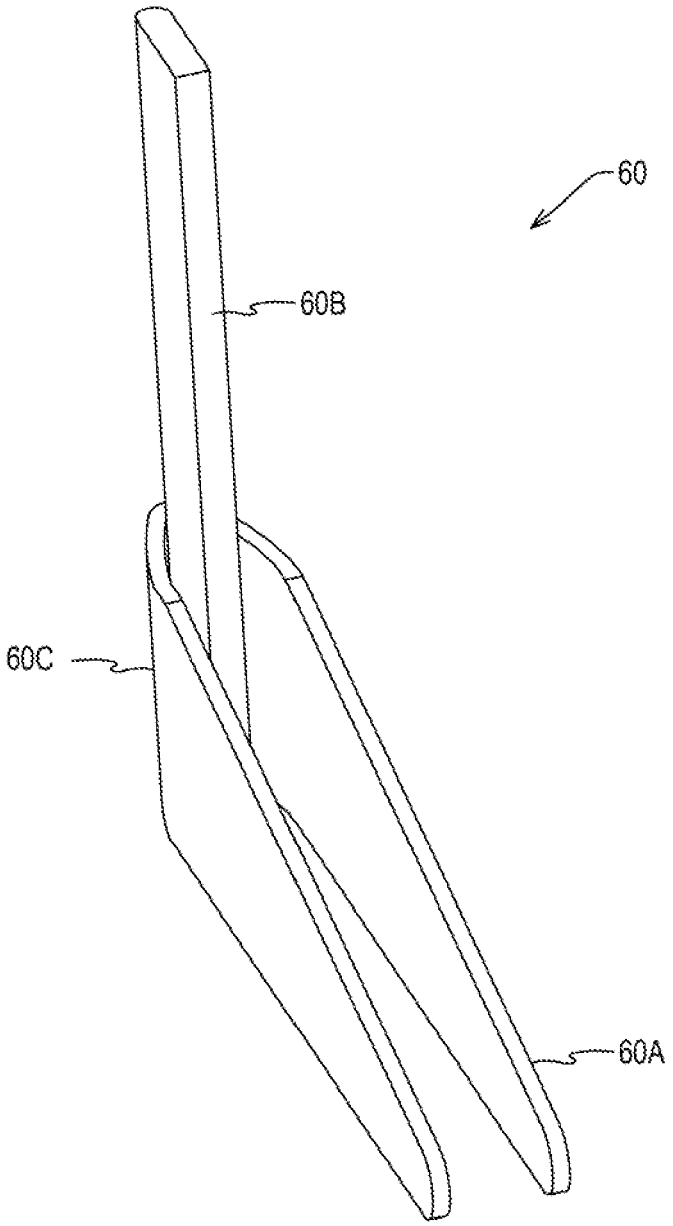
FIG. 5 is a perspective view depicting details of silt fence guide 60 of back filler 14 of FIG. 4A.

Position p1 is an alternate position for a Coulter, such as a disc-type Coulter that may be used in combination with or in place of disc 54A to define the edge of the soil that a tamper head 55A and finishing wheel 56 will draw into trench 8. Disc 54A rotates in trench 8 to break up voids and clods in backfill soil 5A. FIG. 4F is a cross-section view of section E-E of FIG. 4A. Power tamper 55 packs backfill soil 5A into trench 8 by moving a tamper head 55A up and down Finishing wheel 56 smoothes the top of backfill soil 5A to complete the installation. Details of fabric guide 60 are shown in FIG. 5. A mounting arm 60B connects fabric guide 60 to frame 61 of back filler 14, via an adjustable or repositionable mount as described above. A leading edge 60C of a foot of fabric guide 60 is curved and engages silt fence fabric bottom portion 2A and a pair of feet 60A maintain silt fence fabric bottom portion 2A at the bottom of trench 8 as backfill soil 5A is added to trench 8.

Figure 6A:
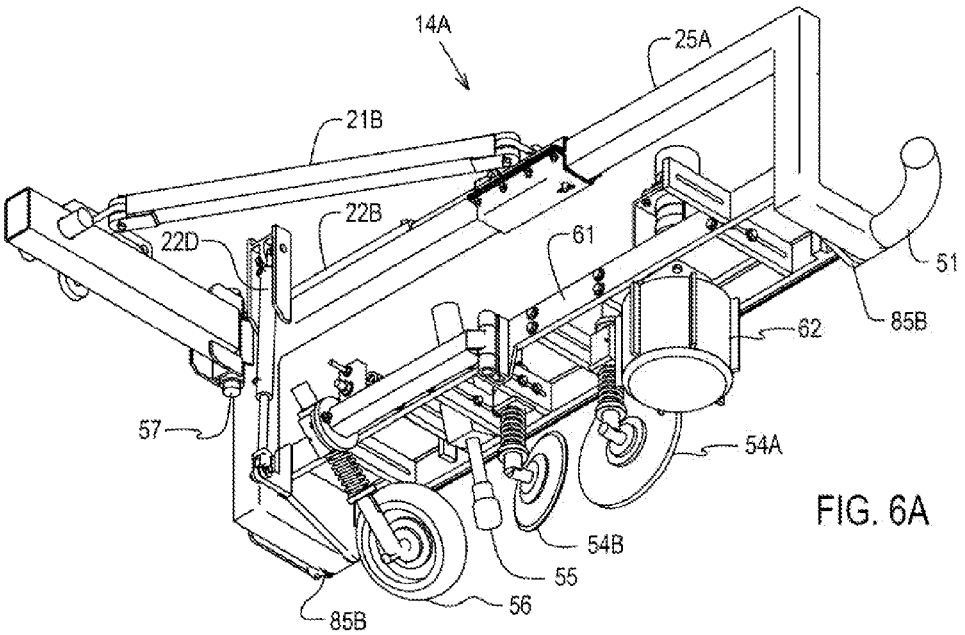
FIGS. 6A-6B are perspective views of an alternative back filler 14A that can be used in place of back filler 14 in FIG. 2B.
Figure 6B:
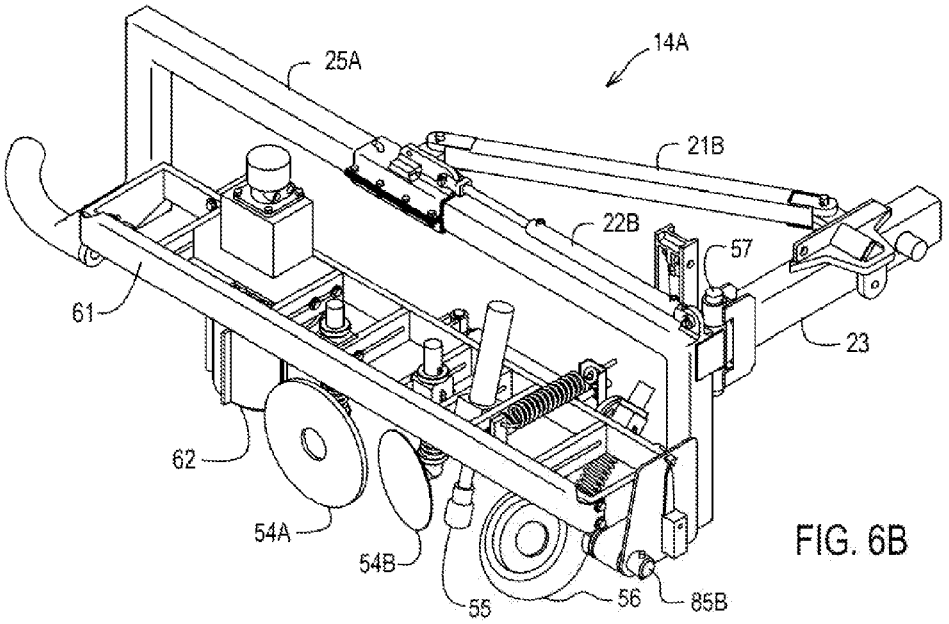

Referring now to FIGS. 6A-6B, a perspective underside view and a perspective top view, respectively, of an alternative back filler 14A that can be used instead of the above-described back filler 14 in silt fence installation equipment 10 of FIGS. 2A-2D is displayed. Back filler 14A is similar to back filler 14, so only differences between them will be described below. Instead of using a blower and fabric guide arrangement, back filler 14A uses a spinning drum 62 with blades that throw soil 5B (FIG. 2A) against silt fence fabric 2 filling trench 8. The remainder of the operations performed by discs MA, MB, power tamper 55 and finishing wheel 56 are as described above for back filler 14.

Figure 7A:
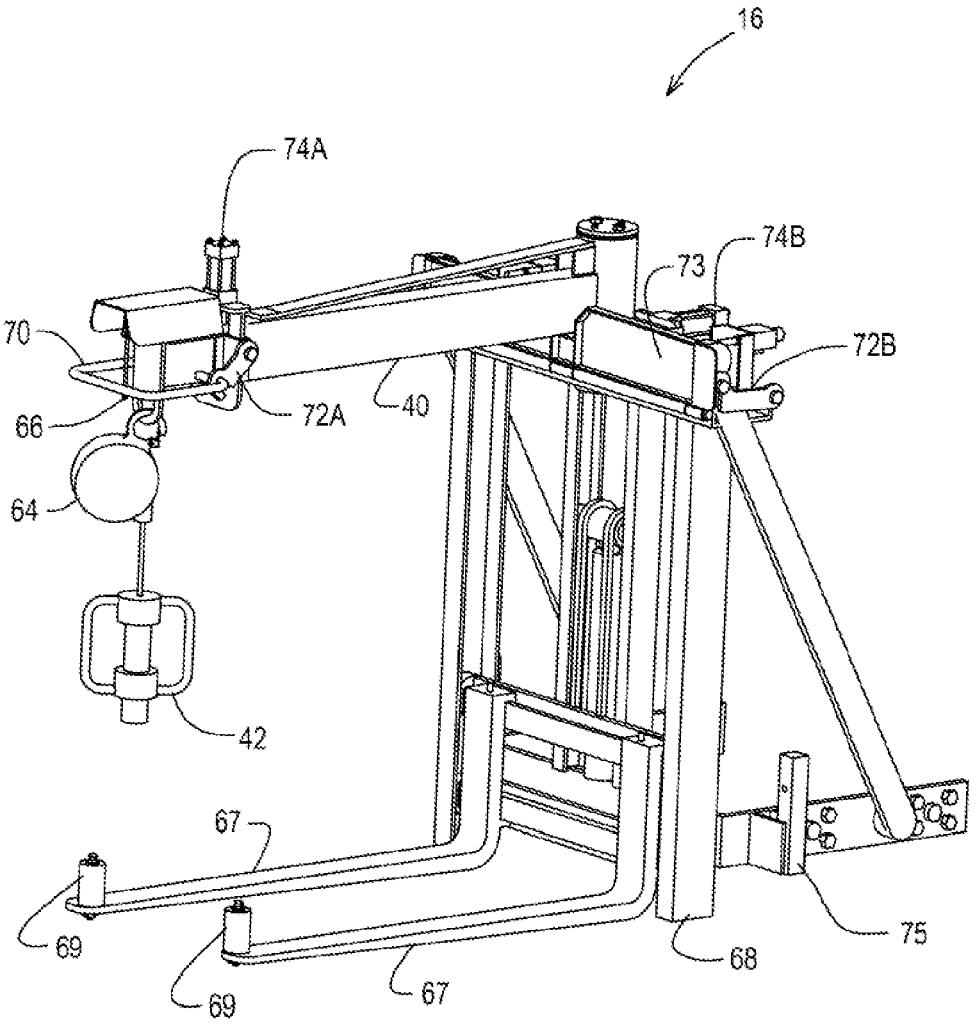
FIGS. 7A-7C are perspective views depicting details of second operator station 16 of FIG. 2A in different orientations.

Referring now to FIG. 7A, a perspective view of the example second operator station 16 is shown, as may be included within silt fence installation equipment 10 of FIGS. 2A-2D. The depicted configuration is a stowed configuration, in which a hook 72A secures telescoping boom 40 from extending by hooking around a handle 70 that is otherwise used by operator O2 to position telescoping boom 40 during silt fence installation. Telescoping boom 40 is further secured against rotation by a locking plate 73. During operation in a non-stowed configuration as will be described below with reference to FIG. 7C, a tool balancer 64 provides for vertical positioning of power hammer 42, and a hydraulic release 66 provides release of hydraulic brakes 74A and 74B, thereby releasing telescoping boom 40, once a hook 72B is released to free locking plate 73, permitting operator O2 to position power hammer 42 as needed to drive stakes 4 (not shown). Second operator station 16 may be adapted to receive standard pallets of prefabricated silt fencing or other materials, by including forks 67 that may be loaded from a forklift or other pallet handling device. A lift 68 may be included in order to operate motive vehicle 15 as a rear-directed forklift for loading pallets of silt fencing or other materials. Pinned stops 69 prevent pallets from sliding off of forks 67. Tool post 75 mounts cradle 44 or other jobsite devices with pinned security.

Figure 7B:
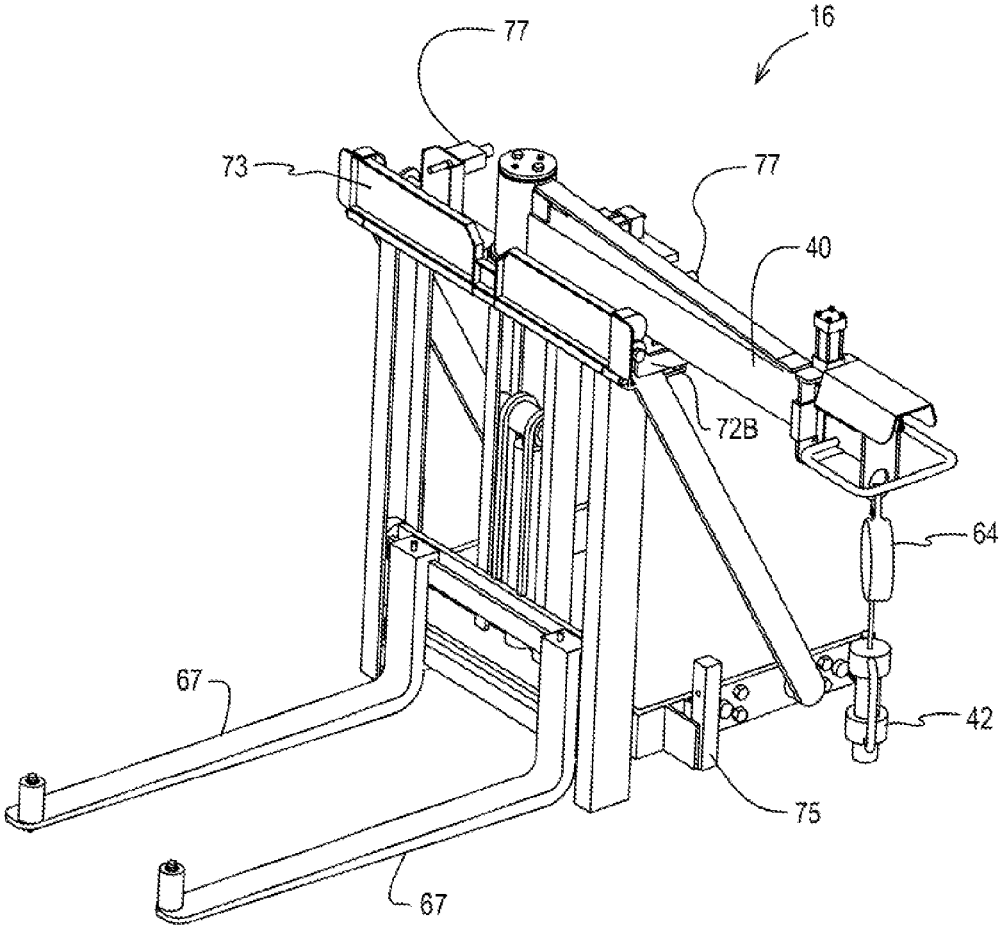

Referring now to FIG. 7B, a perspective view of the example second operator station 16 is shown in a locked configuration for loading or operation of motive vehicle 15 as a forklift. Locking plate 73 is secured by hook 72B to hold telescoping boom 40 at a 90-degree angle with respect to the direction of travel of motive vehicle 15 so that telescoping boom 40, tool balancer 64 and power hammer 42 are held out of the way of forks 67. Hook 72A (not shown) is also engaged to restrain telescoping boom 40 in the depicted configuration. An interlock device 77 such as a valve or switch prevents forks 67 from being raised unless telescoping boom 40 is in a locked configuration for loading as shown in FIG. 7B.

Figure 7C:
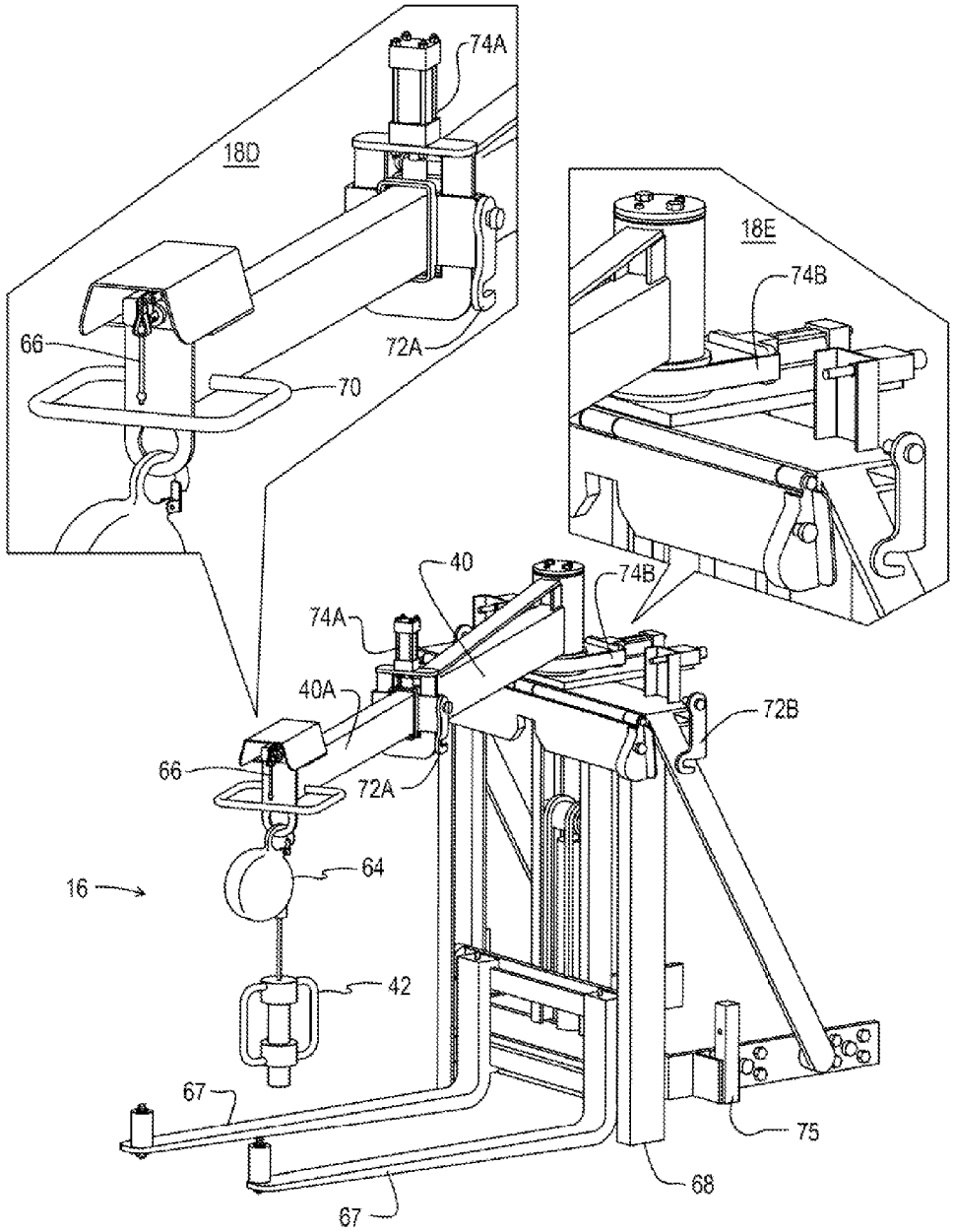

Referring now to FIG. 7C, further details of the example second operator station 16 are shown. Hydraulic brake 74B can be seen, which prevents rotation of telescoping boom 40 when hydraulic release 66 is not engaged. Similarly, a brake 74A holds telescoping boom 40 at a particular extension of a telescoping portion 40A of telescoping boom 40 that is selected by releasing hydraulic release 66. Further details of hydraulic brake 74B can be seen in a detail 18E and further details of brake 74A, handle 70, hook 72A and hydraulic release 66 are shown with respect to telescoping boom 40 in a detail 18D.

Figure 8A:
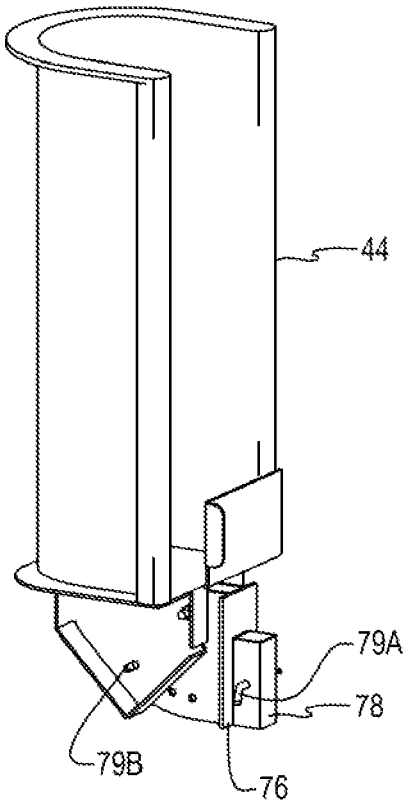
FIGS. 8A-8B are perspective views depicting details of cradle 44 of FIG. 2A in two different configurations.
Figure 8B:
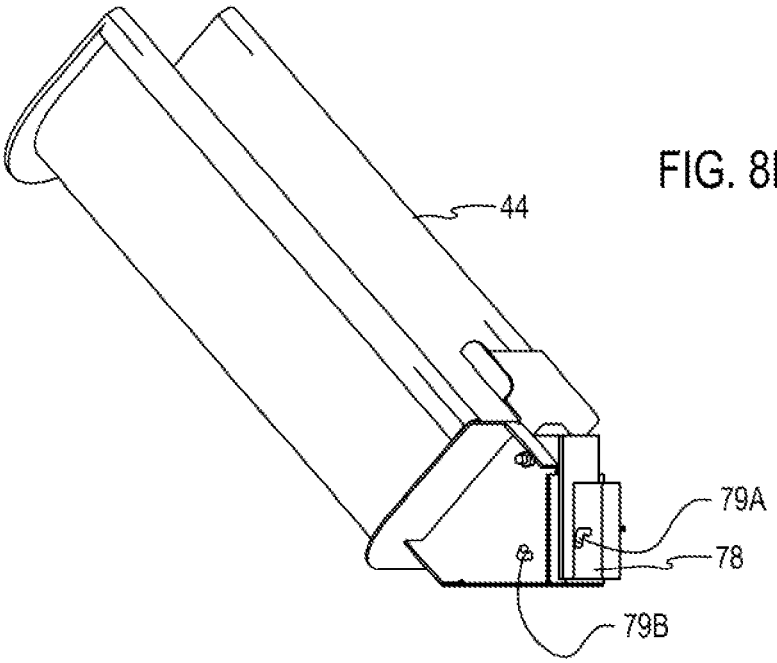

Referring now to FIG. 8A, details of cradle 44 that may be included within second operator station 16 of silt fence installation equipment 10 of FIGS. 2A-2D. Cradle 44 includes a mounting collar 78 that is pinned using a pin 79A to a frame member of motive vehicle 15. A base mount 76 of cradle 44 permits cradle 44 to rotate to various positions as pinned by a pin 79B, including a stowed position as shown in FIG. 8A and an in-use position as shown in FIG. 8B.

While the invention has been particularly shown and described with reference to the preferred embodiment thereof, it will be understood by those skilled in the art that the foregoing and other changes in form, and details may be made therein without departing from the spirit and scope of the invention.

What is claimed is:

1. An equipment for installing prefabricated fencing in a trench, comprising:

a motive vehicle;

a trencher attached to the motive vehicle, the trencher including a trencher frame, a cutting wheel supported by the trencher frame for cutting a trench having a predetermined specified width, a trenching foot supported by the trencher frame and positioned behind the cutting wheel for smoothing sides and a bottom of the trench, and a floating foot that rides along a bottom of the trench and is capable of movement with respect to the trencher frame during cutting of the trench;

a depth indicator mechanically coupled to the floating foot to indicate a depth of the trench at the floating foot;

a first actuator coupled to the trencher for raising and lowering the cutting wheel in response to a command, whereby an operator is capable of controlling a depth of the trench according to an indication of the depth indicator;

a plumb indicator mechanically coupled to the trencher frame to indicate to the operator of the motive vehicle an orientation of the trencher frame with respect to plumb;

a second actuator coupled to the trencher for rotating the trencher frame around an axis parallel to a direction of movement of the motive vehicle in response to another command from the operator, whereby the operator is capable of maintaining the sides of the trench plumb according to another indication of the plumb indicator; and a cradle located behind the trencher for carrying a length of prefabricated fencing prior to installation in the trench.

2. The equipment of claim 1, wherein while operating the trencher to cut the trench, the equipment does not contact the ground on the side of the trench opposite the motive vehicle.

3. The equipment of claim 1, wherein a direction of rotation of the cutting wheel is selectable to rotate in either a selected forward or selected backward rotation.

4. The equipment of claim 1, further comprising:

a pair of parallel arms mechanically coupling the trenching foot to the trencher frame, so that the trenching foot remains parallel to the frame as the trenching foot moves vertically with respect to the sides of the trench; and a spring coupling the trenching foot to the trencher frame to restore the trenching foot to a maximum downward position when the trenching foot is not obstructed.

5. The equipment of claim 1, further comprising an operator station for a second operator, the operator station located behind the trencher, wherein the operator station comprises:

a boom mounted to the motive vehicle behind the trencher; and a power hammer mounted at an end of the boom, whereby the second operator is capable of operating the power hammer to drive stakes of the prefabricated fencing to install the prefabricated fencing in the trench.

6. The equipment of claim 5, wherein the boom is rotatable and telescoping under control of the second operator and includes a locking mechanism, so that the second operator is capable of positioning and locking the power hammer at a variable position alongside the motive vehicle by a combination of rotating the boom and extending or retracting the boom.

7. The equipment of claim 5, wherein the operator station comprises:

a pallet for holding the prefabricated fencing prior to placement in the cradle, wherein the prefabricated fencing is unloaded from the pallet to the cradle as the motive vehicle cuts the trench; and a pair of forks adapted for receiving the pallet.

8. The equipment of claim 1, wherein the trencher is installed on a first side of and in front of the motive vehicle and further comprising a back filler installed on a second side of the motive vehicle for re-filling the trench on a return trip of the motive vehicle with soil that was excavated during a previous trenching pass of the trencher.

9. The equipment of claim 8, wherein while operating the back filler to back fill the trench, the equipment does not contact the ground on a side of the trench opposite the motive vehicle.

10. The equipment of claim 8, wherein the back filler includes:

a fabric guide for guiding a bottom fabric extension of the prefabricated fencing to the bottom of the trench;

a blower for forcing an upper portion of the bottom fabric extension against installed stakes of the prefabricated fencing and into the bottom of the trench; and a blade for moving the excavated soil into the trench.

11. The equipment of claim 10, wherein the back filler further comprises:

one or more disc tools for moving the excavated soil and removing voids;

a power tamper for packing the soil into the trench; and a finishing wheel for further packing and smoothing a top of the soil packed into the trench adjacent to the prefabricated fencing.

12. The equipment of claim 10, wherein the back filler includes a rotating drum having an axis of rotation substantially parallel to the installed stakes for throwing the excavated soil toward the upper portion of the bottom fabric extension of the prefabricated fencing.

13. The equipment of claim 12, further comprising:

one or more disc tools for moving the excavated soil and removing voids;

a power tamper for packing the soil into the trench; and a finishing wheel for further packing and smoothing a top of the soil packed into the trench adjacent to the prefabricated fencing.

14. The equipment of claim 8, further comprising a dozing blade disposed between the back filler and the trencher on the front of the motive vehicle.

15. A method of installing prefabricated fencing, the method comprising:

cutting a trench by moving a motive vehicle having an attached trencher, wherein the trencher includes a trencher frame, a cutting wheel supported by the trencher frame for cutting the trench with a specified predetermined width, a trenching foot supported by the trencher frame and positioned behind the cutting wheel for smoothing sides and a bottom of the trench, and a floating foot that rides along a bottom of the trench and is capable of movement with respect to the trencher frame during cutting of the trench;

maintaining a depth of the trench by providing an indication to a first operator of the motive vehicle of a depth of the trench at the floating foot, wherein the first operator controls a first actuator coupled to the trencher for raising and lowering the cutting wheel in response to a command from the first operator;

maintaining plumb of the trench by providing an indication of an orientation of the trencher frame with respect to plumb to the first operator of the motive vehicle, wherein the first operator controls a second actuator coupled to the trencher frame for rotating the trencher frame around an axis parallel to a direction of movement of the motive vehicle in response to another command from the first operator; and unloading the prefabricated fencing into the trench from a cradle located behind the trencher.

16. The method of claim 15, wherein the cutting is performed so that the motive vehicle and the trencher do not contact the ground on a side of the trench opposite the motive vehicle.

17. The method of claim 15, further comprising the first operator selecting a direction of rotation of the cutting wheel.

18. The method of claim 15, further comprising a second operator driving stakes of the prefabricated fencing from an operator station located behind the trencher, wherein the operator station comprises a boom mounted to the motive vehicle behind the trencher, and a power hammer mounted at the end of the boom for driving the stakes.

19. The method of claim 18, further comprising:

rotating and telescoping the boom to a position alongside the motive vehicle; and locking the boom in the position.

20. The method of claim 18, further comprising loading a pallet of the pre-fabricated fencing onto forks attached to the motive vehicle at the operator station.

21. The method of claim 15, wherein the cutting is performed with the trencher installed on a first side of and in front of the motive vehicle, wherein the method further comprises backfilling the trench on a return trip of the motive vehicle with soil that was excavated during a previous trenching pass of the trencher using a back filler attached to a second side of the motive vehicle.

22. The method of claim 21, wherein the backfilling is performed so that the motive vehicle and the back filler do not contact the ground on a side of the trench opposite the motive vehicle, whereby a protection zone is not disturbed by backfilling.

23. The method of claim 21, further comprising:

guiding a bottom fabric extension of the prefabricated fencing to the bottom of the trench with a fabric guide of the back filler;

maintaining an upper portion of the bottom fabric extension against installed stakes of the prefabricated fencing using a blower of the back filler;

moving the excavated soil into the trench with a blade of the back filler;

moving the excavated soil and removing voids with one or more disc tools of the back filler;

packing the soil into the trench with a power tamper of the back filler; and packing and smoothing a top of the soil packed into the trench adjacent to the prefabricated fencing with a finishing wheel of the back filler.

24. The method of claim 21, further comprising:

moving the excavated soil toward an upper portion of a bottom fabric extension of the prefabricated fencing with a rotating drum having an axis of rotation substantially parallel to installed stakes of the prefabricated fencing;

moving the excavated soil and removing voids with one or more disc tools of the back filler;

packing the soil into the trench with a power tamper of the back filler; and packing and smoothing a top of the soil packed into the trench adjacent to the prefabricated fencing with a finishing wheel of the back filler.

25. An equipment for installing prefabricated fencing in a trench, comprising:

a motive vehicle;

a trencher attached to the motive vehicle, the trencher including a trencher frame, a cutting wheel supported by the trencher frame for cutting a trench having a predetermined specified width, a trenching foot supported by the trencher frame and positioned behind the cutting wheel for smoothing sides and a bottom of the trench, and a floating foot that rides along a bottom of the trench and is capable of movement with respect to the trencher frame during cutting of the trench;

a depth indicator mechanically coupled to the floating foot to indicate a depth of the trench at the floating foot;

a first actuator coupled to the trencher for raising and lowering the cutting wheel in response to a command, whereby an operator is capable of controlling a depth of the trench according to an indication of the depth indicator;

a plumb indicator mechanically coupled to the trencher frame to indicate to the operator of the motive vehicle an orientation of the trencher frame with respect to plumb;

a second actuator coupled to the trencher for rotating the trencher frame around an axis parallel to a direction of movement of the motive vehicle in response to another command from the operator, whereby the operator is capable of maintaining the sides of the trench plumb according to another indication of the plumb indicator;

a cradle located behind the trencher for carrying a length of prefabricated fencing prior to installation in the trench;

a back filler for re-filling the trench on a return trip of the motive vehicle with soil that was excavated during a previous trenching pass of the trencher; and an operator station located behind the trencher, including a telescoping, rotating and locking boom mounted to the motive vehicle behind the trencher with a power hammer mounted at the end of the boom, whereby a second operator is capable of operating the power hammer to drive stakes of the prefabricated fencing to install the prefabricated fencing in the trench, wherein while operating the trencher to cut the trench and operating the back filler to back fill the trench, the equipment does not contact the ground on a side of the trench opposite the motive vehicle.

* * * * *